US012624702B2

(12) United States Patent
Yoshida et al.

(10) Patent No.: US 12,624,702 B2
(45) Date of Patent: May 12, 2026

(54) COMPRESSOR TRAIN OF CHEMICAL PLANTS AND METHOD OF OPERATING COMPRESSOR TRAIN OF CHEMICAL PLANTS

(71) Applicant: MITSUBISHI HEAVY INDUSTRIES COMPRESSOR CORPORATION, Tokyo (JP)

(72) Inventors: Satoru Yoshida, Hiroshima (JP); Daisuke Kiuchi, Hiroshima (JP); Yuta Miwada, Hiroshima (JP); Tomoaki Nogami, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 173 days.

(21) Appl. No.: 18/694,467

(22) PCT Filed: Aug. 10, 2022

(86) PCT No.: PCT/JP2022/030626
§ 371 (c)(1),
(2) Date: Mar. 22, 2024

(87) PCT Pub. No.: WO2023/047834
PCT Pub. Date: Mar. 30, 2023

(65) Prior Publication Data

US 2025/0129789 A1 Apr. 24, 2025

(30) Foreign Application Priority Data

Sep. 24, 2021 (JP) ..... 2021-155311

(51) Int. Cl.
*F04D 25/04* (2006.01)
*F04D 25/06* (2006.01)
*F04D 27/00* (2006.01)

(52) U.S. Cl.
CPC ..... *F04D 25/04* (2013.01); *F04D 25/06* (2013.01); *F04D 27/004* (2013.01)

(58) Field of Classification Search
CPC ..... F01D 11/003; F01D 15/10; F04D 25/04; F04D 25/06; F04D 27/004
See application file for complete search history.

(56) References Cited

U.S. PATENT DOCUMENTS 3,398,525 A * 8/1968 Jenny ..... F02C 3/02 60/39.182
5,402,631 A * 4/1995 Wulf ..... F25J 3/04133 60/785

(Continued)

FOREIGN PATENT DOCUMENTS

CN 101124385 A * 2/2008 ..... F01K 17/02
CN 109642468 A * 4/2019 ..... H02P 9/04

(Continued)

OTHER PUBLICATIONS

International Search Report Issued in Corresponding PCT Application No. PCT/JP2022/030626, dated Nov. 1, 2022. (5 Pages with English Translation).

(Continued)

*Primary Examiner* — Alexander B Comley
(74) *Attorney, Agent, or Firm* — Osha Bergman Watanabe & Burton LLP

(57) ABSTRACT

A compressor train of chemical plants includes: a compression unit which is driven to compress a process gas of the chemical plants; a steam turbine which is rotated by steam generated in accordance with the processing of the process gas of the chemical plants to drive the compression unit; a motor which is able to assist the rotation of the steam (Continued)

turbine; and a frequency conversion unit which is connected to an electric power system and controls the rotation of the motor.

6 Claims, 11 Drawing Sheets

(56) References Cited

U.S. PATENT DOCUMENTS

| | | | | | |
|---|---|---|---|---|---|
| 6,050,780 | A * | 4/2000 | Hasegawa | F04D 25/163 | 417/423.5 |
| 6,116,027 | A * | 9/2000 | Smith | F25J 3/04139 | 60/648 |
| 10,774,746 | B2 * | 9/2020 | Kerth | F02C 9/18 | |
| 2006/0228284 | A1 * | 10/2006 | Schmidt | C10K 1/005 | 423/352 |
| 2011/0225977 | A1 * | 9/2011 | Kim | F01D 15/10 | 60/783 |
| 2014/0076081 | A1 * | 3/2014 | Aschenbruck | F01D 15/12 | 74/413 |
| 2016/0230771 | A1 * | 8/2016 | Dobat | F04D 25/04 | |
| 2018/0313233 | A1 * | 11/2018 | Tateno | F01K 15/02 | |
| 2019/0292928 | A1 * | 9/2019 | Nogami | F01D 19/00 | |
| 2020/0182334 | A1 * | 6/2020 | Bradley | F16H 3/725 | |

FOREIGN PATENT DOCUMENTS

| | | | | |
|---|---|---|---|---|
| CZ | 2015686 | A3 * | 9/2016 | F01D 15/10 |
| DE | 102012018468 | A1 * | 3/2014 | F01D 13/003 |
| EP | 1197717 | A1 * | 4/2002 | F25J 3/04109 |
| EP | 2128448 | A2 * | 12/2009 | F04D 25/163 |
| EP | 3725865 | A1 * | 10/2020 | C10G 9/24 |
| EP | 3816452 | A1 * | 5/2021 | F04D 29/403 |
| GB | 967091 | A * | 8/1964 | F04D 25/163 |
| JP | H01182501 | A * | 7/1989 | |
| JP | H04-091306 | A | 3/1992 | |
| JP | H0491306 | A * | 3/1992 | |
| JP | H09119378 | A * | 5/1997 | F04D 27/0261 |
| JP | 2000-154020 | A | 6/2000 | |
| JP | 2005-325752 | A | 11/2005 | |
| JP | 2008535768 | A * | 9/2008 | C01B 13/0229 |
| JP | 2018188996 | A * | 11/2018 | F01K 15/02 |
| JP | 7333247 | B2 * | 8/2023 | F04D 25/045 |
| TW | 201812167 | A * | 4/2018 | F02C 7/275 |
| WO | WO-2018007567 | A2 * | 1/2018 | F25J 1/0287 |

OTHER PUBLICATIONS

Written Opinion of the International Searching Authority issued in Corresponding PCT Application No. PCT/JP2022/030626, dated Nov. 1, 2022. (8 Pages with English Translation).

* cited by examiner

COMPRESSOR TRAIN OF CHEMICAL PLANTS AND METHOD OF OPERATING COMPRESSOR TRAIN OF CHEMICAL PLANTS

TECHNICAL FIELD

The present disclosure relates to a compressor train of chemical plants and a method of operating a compressor train of chemical plants.

Priority is claimed on Japanese Patent Application No. 2021-155311, filed Sep. 24, 2021, the content of which is incorporated herein by reference.

BACKGROUND ART

For example, Patent Document 1 discloses an ammonia production compressor system used in an ammonia plant as a chemical plant that produces ammonia.

This ammonia production compressor system includes low-pressure side and high-pressure side compressors (hereinafter, referred to as compression units), and a drive machine (steam turbine) that drives the compression units.

CITATION LIST

Patent Document

Patent Document 1

Japanese Unexamined Patent Application, First Publication No. 2000-154020

SUMMARY OF INVENTION

Technical Problem

Incidentally, in chemical plants such as ammonia plants, when the rated rotational speed in the compression unit is increased or when the amount of steam generated in the manufacturing process is decreased, the amount of steam introduced into the steam turbine may be insufficient compared to the amount of steam required for the rated rotation of the compression unit.

In this case, in the technique described in Patent Document 1, there is a problem unique to chemical plants in that the rotational speed of the compression unit is not easily stabilized and the pressure of the process gas compressed by the compression unit is unstable.

The present disclosure has been made to solve the above-described problems and an object of the present disclosure is to provide a compressor train of chemical plants capable of stabilizing the pressure of a process gas compressed by a compression unit and a method of operating the compressor train of chemical plants.

Solution to Problem

In order to achieve the aforementioned objects, a compressor train of chemical plants according to the present disclosure includes: a compression unit which is driven to compress a process gas of the chemical plants; a steam turbine which is rotated by steam generated in accordance with the processing of the process gas of the chemical plants to drive the compression unit; a motor which is able to assist a rotation of the steam turbine; and a frequency conversion unit which is connected to an electric power system and controls a rotation of the motor.

A method of operating a compressor train of chemical plants according to the present disclosure is a method of operating a compressor train of chemical plants including a compression unit which is driven to compress a process gas of the chemical plants, a steam turbine which is rotated by steam generated in accordance with the processing of the process gas of the chemical plants to drive the compression unit, a motor which is able to assist the rotation of the steam turbine, a frequency conversion unit which is connected to an electric power system and controls the rotation of the motor, a shaft seal device which seals a gap between a stator of the steam turbine and a rotor of the steam turbine, and a vacuum pump which is driven to be able to reduce the pressure inside the steam turbine, the method including: an evacuation step of reducing the pressure inside the steam turbine by driving the vacuum pump while the inflow of the steam generated in accordance with the processing of the process gas into the steam turbine is stopped; a motor starting step of starting to drive the steam turbine by starting to drive the motor while the inflow of the steam into the steam turbine is stopped after the evacuation step is completed; a motor driving step of continuing to drive the motor after the motor starting step is completed; and a first steam switching step of starting the inflow of the steam into the steam turbine when amount of the steam generated in accordance with the driving of the motor becomes a specified amount or more while the motor continues to drive.

Advantageous Effects of Invention

According to the present disclosure, it is possible to provide the compressor train of chemical plants capable of stabilizing the pressure of the process gas compressed by the compression unit and the method of operating the compressor train of chemical plants.

DESCRIPTION OF EMBODIMENTS

Hereinafter, a compressor train for a chemical plant and a method of operating the compressor train of chemical plants according to an embodiment of the present disclosure will be described with reference to the drawings.

First Embodiment (Compressor Train of Chemical Plants)

A compressor train for a chemical plant compresses a process gas generated in the chemical plant, and supplies the compressed process gas to a reaction device provided in the chemical plant.

When the chemical plant is an ammonia plant, an example of the reaction device is an ammonia converter that generates ammonia through a chemical reaction at high temperature and high pressure, and an example of the process gas is a gas containing hydrogen as a main component. The chemical plant of this embodiment is an ammonia plant that produces ammonia.

Figure 1:
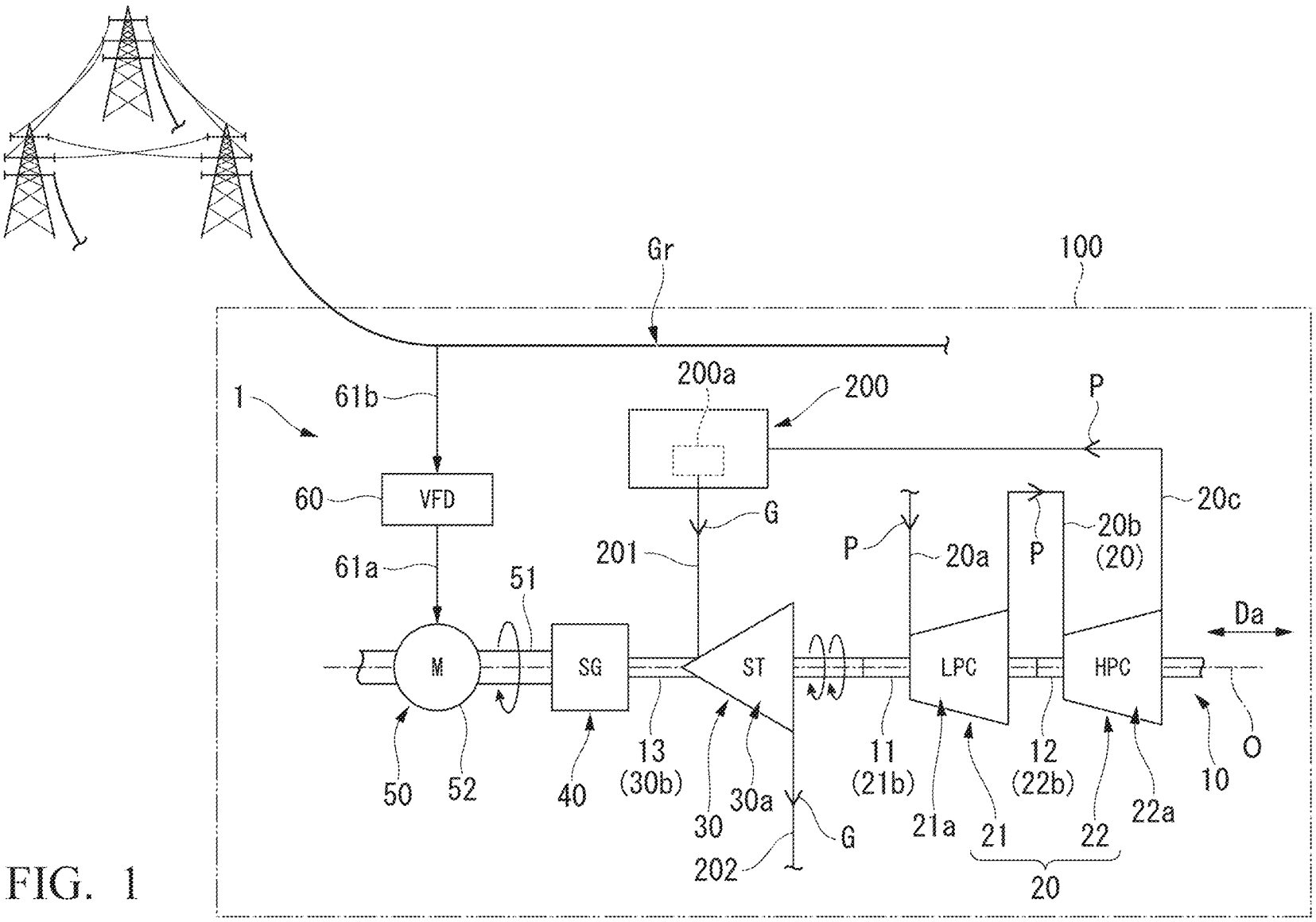
FIG. 1 is a schematic view showing a configuration of a compressor train of chemical plants according to a first embodiment of the present disclosure.

As shown in FIG. 1, an ammonia plant 100 includes a compressor train 1 for a chemical plant, an ammonia converter 200, a gas introduction line 20*a*, a gas discharge line 20*c*, a first power purchasing cable 61*a*, and a second power purchasing cable 61*b*.

The compressor train 1 of chemical plants includes a compression unit 20, a steam turbine 30, a speed increaser 40, a motor 50, a frequency conversion unit 60, a steam introduction line 201, and a steam discharge line 202.

(Compression Unit)

The compression unit 20 compresses a process gas P used in the ammonia plant 100 and supplied from the outside and supplies the compressed process gas P to the ammonia converter 200.

The compression unit 20 includes a low-pressure stage compressor 21 (LPC; Low Pressure Compressor), a high-pressure stage compressor 22 (HPC: High Pressure Compressor), and an intermediate line 20*b*.

The low-pressure stage compressor 21 is a rotating machine that increases the process gas P supplied from the outside to a predetermined first pressure value. The low-pressure stage compressor 21 includes a first casing 21*a* and a first rotor 21*b*.

The first casing 21*a* is a member forming the outer shell of the low-pressure stage compressor 21. The first casing 21*a* is supported by a compressor support part (not shown) fixed to the ground, pedestal, or the like, and allows the process gas P to flow therein.

The first casing 21*a* includes a casing body (not shown), an inlet (not shown) for sucking the process gas P formed in the casing body, and an outlet (not shown) for discharging the process gas P formed in the casing body.

The first rotor 21*b* includes a first rotating shaft 11 and multi-stages impellers (not shown) which are fixed to the first rotating shaft 11 and form a flow path for compressing the process gas P together with the inner surface of the casing body of the first casing 21*a*.

The first rotating shaft 11 is a drive shaft that has a columnar shape extending in the axial direction Da (left and right direction in FIG. 1) and is rotatable around an axis O extending in the horizontal direction. Hereinafter, the direction in which the axis O extends is referred to as the "axial direction Da". The first rotating shaft 11 is made of metal or the like. The casing body of the first casing 21*a* is fixed to the first rotating shaft 11 in a non-rotatable manner, for example, via a bearing device, a seal device, or the like.

The impellers are accommodated in the casing body of the first casing 21*a*. The impellers are arranged on the first rotating shaft 11 to be lined up in the axial direction Da, and rotate around the axis O together with the first rotating shaft 11.

The flow of the process gas P introduced into the low-pressure stage compressor 21 will be described. The gas introduction line 20*a* which is a pipe for introducing the process gas P before compressing is connected to the inlet of the first casing 21*a* in the low-pressure stage compressor and the process gas P is introduced from a process gas processing device (not shown) outside the compression unit 20 in the ammonia plant 100 through the gas introduction line 20*a*.

The process gas P introduced into the first casing 21*a* through the inlet is sequentially compressed by the impellers of the first rotor 21*b* rotating at a high speed inside the first casing 21*a*. The process gas P compressed to the first pressure value by the impeller in the last stage is discharged to the outside of the low-pressure stage compressor 21 via the outlet of the first casing 21*a*.

The high-pressure stage compressor 22 is a rotating machine that increases the pressure of the process gas P compressed by the low-pressure stage compressor 21 to a second pressure value higher than the first pressure value. The high-pressure stage compressor 22 and the low-pressure stage compressor 21 are connected by the intermediate line 20*b* which is a pipe through which the process gas P flows.

That is, the process gas P compressed by the low-pressure stage compressor 21 is introduced into the high-pressure stage compressor 22 through the intermediate line 20*b*. The second pressure value of this embodiment is, for example, the pressure (atmospheric pressure) required for the chemical reaction within the ammonia converter 200.

The high-pressure stage compressor 22 is disposed on one side in the axial direction Da of the low-pressure stage compressor 21 (on the right side in FIG. 1). The high-pressure stage compressor 22 includes a second casing 22*a* and a second rotor 22*b*.

The second casing 22*a* is a member forming the outer shell of the high-pressure stage compressor 22. The second casing 22*a* is supported by a compressor support part (not shown) fixed to the ground, pedestal, or the like, and allows the process gas P to flow therein.

The second casing 22*a* includes a casing body (not shown), an inlet (not shown) for sucking the process gas P formed in the casing body, and an outlet (not shown) for discharging the process gas P formed in the casing body.

The second rotor 22*b* includes a second rotating shaft 12 and multi-stage impellers (not shown) which are fixed to the second rotating shaft 12 and form a flow path for compressing the process gas P together with the inner surface of the casing body of the second casing 22*a*.

The second rotating shaft 12 is a drive shaft that has a columnar shape extending in the axial direction Da and is rotatable around the axis O. The second rotating shaft 12 is made of metal or the like. The casing body of the second casing 22*a* is fixed to the second rotating shaft 12 in a non-rotatable manner, for example, via a bearing device, a seal device, or the like.

The impellers are accommodated in the casing body of the second casing 22*a*. The impellers are arranged on the second rotating shaft 11 to be lined up in the axial direction Da, and rotate around the axis O together with the second rotating shaft 11.

Here, the end on one side in the axial direction Da of the first rotating shaft 11 of the first rotor 21*b* in the low-pressure stage compressor 21 and the end on the other side in the axial direction Da of the second rotating shaft 12 of the second rotor 22*b* in the high-pressure stage compressor 22 are integrally connected. Specifically, the first rotating shaft 11 and the second rotating shaft 12 are elastically connected by a flexible joint or the like (not shown).

The first rotating shaft 11 and the second rotating shaft 12 are connected so that their centers are aligned. That is, the center line of the first rotating shaft 11 and the center line of the second rotating shaft 12 are on the same straight line. That is, the first rotating shaft 11 and the second rotating shaft 12 share the axis O as a center line.

These low-pressure stage compressor 21 and high-pressure stage compressor 22 constitute a two-stage compression mechanism (multi-stage compressor).

The flow of the process gas P introduced into the high-pressure stage compressor 22 will be described. The process gas P introduced into the second casing 22*a* through the inlet of the second casing 22*a* is compressed by the second rotor 22*b* rotating at a high speed inside the second casing 22*a*.

The process gas P compressed to the second pressure value by the impeller in the last stage is discharged to the outside of the high-pressure stage compressor 22 through the outlet of the second casing 22*a*. The gas discharge line 20*c* which is a pipe for discharging the process gas P after compression is connected to the outlet and the process gas P is supplied to the ammonia converter 200 outside the compression unit 20 through the gas discharge line 20*c*.

The process gas P ($H_2$) introduced into the ammonia converter 200 via the compression unit 20 is used for a chemical reaction with nitrogen ($N_2$) in the presence of a catalyst in the ammonia converter 200. This chemical reaction produces ammonia ($NH_3$) in the ammonia converter 200.

The ammonia converter 200 includes a boiler 200*a* as a heat exchanger that generates steam G using the heat generated by this chemical reaction. The steam G generated in the boiler 200*a* of the ammonia converter 200 is introduced into the steam turbine 30 as a working fluid for the steam turbine 30.

(Steam Turbine)

The steam turbine 30 (ST: Steam Turbine) is a rotating machine that drives the compression unit 20 using the steam G generated during processing of the process gas P of the ammonia plant 100. The steam G generated by the boiler 200*a* of the ammonia converter 200 is introduced to the steam turbine 30 of this embodiment through the steam introduction line 201.

The steam turbine 30 is disposed on the other side in the axial direction Da of the compression unit 20 (on the left side in FIG. 1). The steam turbine 30 includes a turbine stator 30*a* and a turbine rotor 30*b*.

The turbine stator 30*a* includes a turbine casing (not shown) through which the steam G flows and multi-stage stator vanes (not shown) which extend inward from the inner surface of the turbine casing and rectify the flow of the steam G as a working fluid.

The turbine casing is a member forming the outer shell of the steam turbine 30. The turbine casing includes a turbine casing body, a steam inlet for introducing the steam G formed in the turbine casing body, and a steam outlet for discharging the steam G formed in the turbine casing body.

The turbine casing body is supported by a turbine support part (not shown) fixed to the ground, pedestal, or the like, and allows the steam G to flow therein.

The stator vane extends inward from the inner surface of the turbine casing body. The stator vane rectifies the flow of the steam G as a working fluid inside the turbine casing body.

The turbine rotor 30*b* includes a turbine rotating shaft 13 and multi-stage rotor blades which are fixed to the turbine rotating shaft 13 and rotate around the axis O together with the turbine rotating shaft 13 when the steam G rectified by the stator vanes of the turbine stator 30*a* collides with the rotor blades.

The turbine rotating shaft 13 is a drive shaft that has a columnar shape extending in the axial direction Da and is rotatable around the axis O. The turbine rotating shaft 13 is made of metal or the like. The turbine casing body is fixed to the turbine rotating shaft 13 in a non-rotatable manner, for example, via a bearing device, a seal device, or the like.

The rotor blade is accommodated in the turbine casing body. The rotor blade is formed integrally with the turbine rotating shaft 13 and extends outward from the outer surface of the turbine rotating shaft 13. The rotor blade receives a pressure as a rotational force that rotates the turbine rotating shaft 13 from the steam G inside the turbine casing body.

The turbine rotor 30*b* forms a flow path of the steam G together with the inner surface of the turbine casing body and the surface of the stator vane in the turbine casing. These stator vanes and rotor blades are alternately arranged in the axial direction Da.

The flow of the steam G introduced into the steam turbine 30 will be described below. The steam G introduced into the turbine casing body through the steam inlet connected to the steam introduction line 201 is rectified by the stator vanes and collides with the rotor blade in the later stage to rotate the rotor blade around the axis O. The steam G colliding with the rotor blade is rectified again by the stator vane in the later stage and then collides with the rotor blade in the later stage.

The steam G introduced into the turbine stator 30*a* continues to rotate the turbine rotor 30*b* by repeating rectification by the stator vanes and collision with the rotor blades. That is, the steam G introduced into the steam turbine 30 continues to rotate the turbine rotating shaft 13 of the turbine rotor 30*b*.

Here, the end on one side in the axial direction Da of the turbine rotating shaft 13 in the turbine rotor 30*b* and the end on the other side in the axial direction Da of the first rotating shaft 11 in the first rotor 21*b* are integrally connected. Specifically, the turbine rotating shaft 13 and the first rotating shaft 11 are elastically connected by a flexible joint or the like (not shown).

The turbine rotating shaft 13 and the first rotating shaft 11 are connected so that their centers are aligned. That is, the center line of the turbine rotating shaft 13 and the center line of the first rotating shaft 11 are on the same straight line. That is, the turbine rotating shaft 13 and the first rotating shaft 11 share the axis O as a center line.

Thus, when the steam turbine 30 rotates the turbine rotating shaft 13, the first rotating shaft 11 and the second rotating shaft 12 of the compression unit 20 rotate in accordance with this rotation. Thus, the compression unit 20 is driven by the rotation of the steam turbine 30.

In this embodiment, the turbine rotating shaft 13 of the steam turbine 30, the first rotating shaft 11 of the low-pressure stage compressor 21, and the second rotating shaft 12 of the high-pressure stage compressor 22 are integrated to configure the rotating shaft 10 which is one drive shaft extending in the axial direction Da. That is, the rotating shaft 10 is rotatable around the axis O about the axis O.

After the steam G collides with the rotor blade in the last stage, the steam is discharged to the outside of the steam turbine 30 through the steam outlet of the turbine casing. The steam discharge line 202 which is a pipe for discharging the steam G is connected to the steam outlet and the steam G is discharged to the outside through the steam discharge line 202.

Furthermore, the steam G discharged to the outside of the steam turbine 30 is introduced into, for example, a condenser (not shown) for removing a dissolved gas such as oxygen contained in the steam G. The dissolved gas contained in the steam G introduced into the condenser is degassed by a deaerator.

(Speed Increaser)

The speed increaser 40 (SG: Step-up Gear) is a gear device (gearbox) that connects the rotating shaft 10 and the motor 50 and can increase the rotational speed of the rotating shaft 10 to a higher speed than the rotational speed of the motor 50.

That is, the speed increaser 40 is interposed between the compression unit 20 and the motor 50 and can increase the rotational speeds of the first rotating shaft 11 and the second rotating shaft 12 of the compression unit 20 and the rotational speed of the turbine rotating shaft 13 of the steam turbine 30 to a speed higher than the rotational speed of the motor 50.

The speed increaser 40 of this embodiment includes, for example, a gear coupling that is a type of flexible shaft coupling configured by a plurality of pinion gears arranged in parallel in the axial direction Da.

The pinion gear of the gear coupling is fixed to cover the other end of the rotating shaft 10 in the axial direction Da of the turbine rotating shaft 13 and a part of the motor 50 from the outside. The speed increaser 40 connects the rotating shaft 10 and the motor 50 at a predetermined gear ratio.

(Motor)

The motor 50 (M: Motor) is a rotating machine that functions as an electric motor that can assist the rotation of the steam turbine 30. A voltage is applied to the motor 50 from the outside, and the motor 50 is rotated at a rotational speed based on the magnitude of the applied voltage.

The motor 50 includes an output shaft 51 and a motor body 52.

The output shaft 51 is a columnar member (motor shaft) made of metal or the like to extend in the axial direction Da and be rotatable around the axis O. The end on one side in the axial direction Da of the output shaft 51 is connected to the speed increaser 40. Specifically, the end on one side in the axial direction Da of the output shaft 51 is fixed to the pinion gear of the gear coupling of the speed increaser 40.

Here, the output shaft 51 and the rotating shaft 10 are separated from each other in the horizontal direction and the center line of the rotating shaft 10 and the center line of the output shaft 51 are on the same straight line. That is, the output shaft 51 and the rotating shaft 10 share the axis O as a center line.

The motor body 52 includes, for example, a motor stator (not shown) which serves as a stator and a motor rotor (not shown) which is integrally fixed to the output shaft 51 and serves as a rotor.

The motor stator is electrically connected to a device outside the motor 50. When a current flows to the coils of the motor stator, an electromagnetic force is generated that rotates the motor rotor in the circumferential direction of the output shaft 51 with axis O as the reference (center).

Thus, when power is input from the outside to the motor stator of the motor body 52, the output shaft 51 rotates. When the output shaft 51 rotates, the speed increaser 40 connecting the output shaft 51 and the turbine rotating shaft 13 increases the rotational speed of the turbine rotating shaft 13 to a higher speed than the rotational speed of the motor 50. That is, the motor 50 functions as an electric motor that can assist the rotation of the turbine rotating shaft 13 rotated by the steam turbine 30.

(Frequency Conversion Unit)

The frequency conversion unit 60 (VFD: Variable Frequency Drive) is a device that is connected to an electric power system Gr outside the compressor train 1 of chemical plants and controls the rotation of the motor 50. The frequency conversion unit 60 of this embodiment is an inverter that is connected to the electric power system Gr and the motor 50, converts DC power supplied from the electric power system Gr into three-phase AC power, and supplies the AC power to the motor 50.

The first power purchasing cable 61*a* and the second power purchasing cable 61*b* are connected to the frequency conversion unit 60. The first power purchasing cable 61*a* electrically connects the frequency conversion unit 60 and the motor stator of the motor 50. The second power purchasing cable 61*b* electrically connects the frequency conversion unit 60 and the electric power system Gr.

Accordingly, DC power flowing through the electric power system Gr is input to the frequency conversion unit 60 through the second power purchasing cable 61*b*. The DC power input to the frequency conversion unit 60 is converted into AC power by, for example, a power module or the like of the frequency conversion unit 60 and then is input to the motor 50 through the first power purchasing cable 61*a*. Thus, the motor 50 is driven by purchasing power from the electric power system Gr through the frequency conversion unit 60.

Operation and Effect

The process gas P compressed by the compression unit 20 is supplied to the ammonia converter 200 in the ammonia plant 100, and the process gas P is used in a chemical reaction to generate ammonia. Steam G is generated in the boiler 200*a* included in the ammonia converter 200 as the process gas P is processed (chemical reaction) inside the ammonia converter 200, and the generated steam G is introduced into the steam turbine 30.

Here, for example, when the speed of the chemical reaction inside the ammonia converter 200 decreases, the amount of the steam G generated in the boiler 200*a* during a certain period of time may decrease, that is, the amount of the steam G introduced into the steam turbine 30 that drives the compression unit 20 may decrease. Further, when it is desired to increase the rated rotational speed (rated rotational speed) of the compression unit 20, the amount of the steam G introduced into the steam turbine 30 that drives the compression unit 20 will be insufficient.

As described above, the amount of the steam G introduced into the steam turbine 30 may be smaller than the amount of the steam G required for the rated rotation of the compression unit 20.

In the compressor train 1 of chemical plants according to the above embodiment, since the motor 50 can assist the rotation of the steam turbine 30 on the basis of the rotation control of the frequency conversion unit 60, the rotational speed of the steam turbine 30 that drives the compression unit 20 can be increased with the assistance of the motor 50.

Accordingly, even when the amount of the steam G introduced into the steam turbine 30 is insufficient with respect to the amount of the steam G required for the rated rotation of the compression unit 20, the rotational speed of the compression unit 20 can be increased and hence the rotational speed of the compression unit 20 can be made appropriate. Thus, the pressure of the process gas P compressed by the compression unit 20 can be stabilized.

Further, since the motor 50 can assist the rotational speed of the steam turbine 30, it is possible to suppress an increase in the amount of the steam G to be introduced into the steam turbine 30 when increasing the rotational speed of the steam turbine 30. Thus, the size of the steam turbine 30 and the compression unit 20 can be reduced compared to the compressor train 1 of chemical plants without the motor 50. That is, the steam turbine 30 and the compression unit 20 can be made more compact.

Further, since the motor 50 can assist the rotation of the steam turbine 30, the motor 50 can rotate the steam turbine 30 when the steam turbine 30 is started (at the start of operation). Accordingly, an auxiliary boiler or the like to start the steam turbine 30 is not required. Thus, costs in manufacturing the compressor train 1 of chemical plants can be reduced. Further, since an auxiliary boiler or the like is not required, the overall size of the compressor train 1 of chemical plants can be made compact.

Further, since the compressor train 1 of chemical plants according to the above embodiment includes the speed increaser 40 interposed between the compression unit 20 and the motor 50, the motor 50 can more efficiently increase the rotational speed of the steam turbine 30. Further, since the speed increaser 40 rotates the steam turbine 30 and the compression unit 20 faster than the motor 50, the steam turbine 30 and the compression unit 20 can be made more compact than the compressor train 1 of chemical plants without the speed increaser 40.

Second Embodiment

Figure 2:
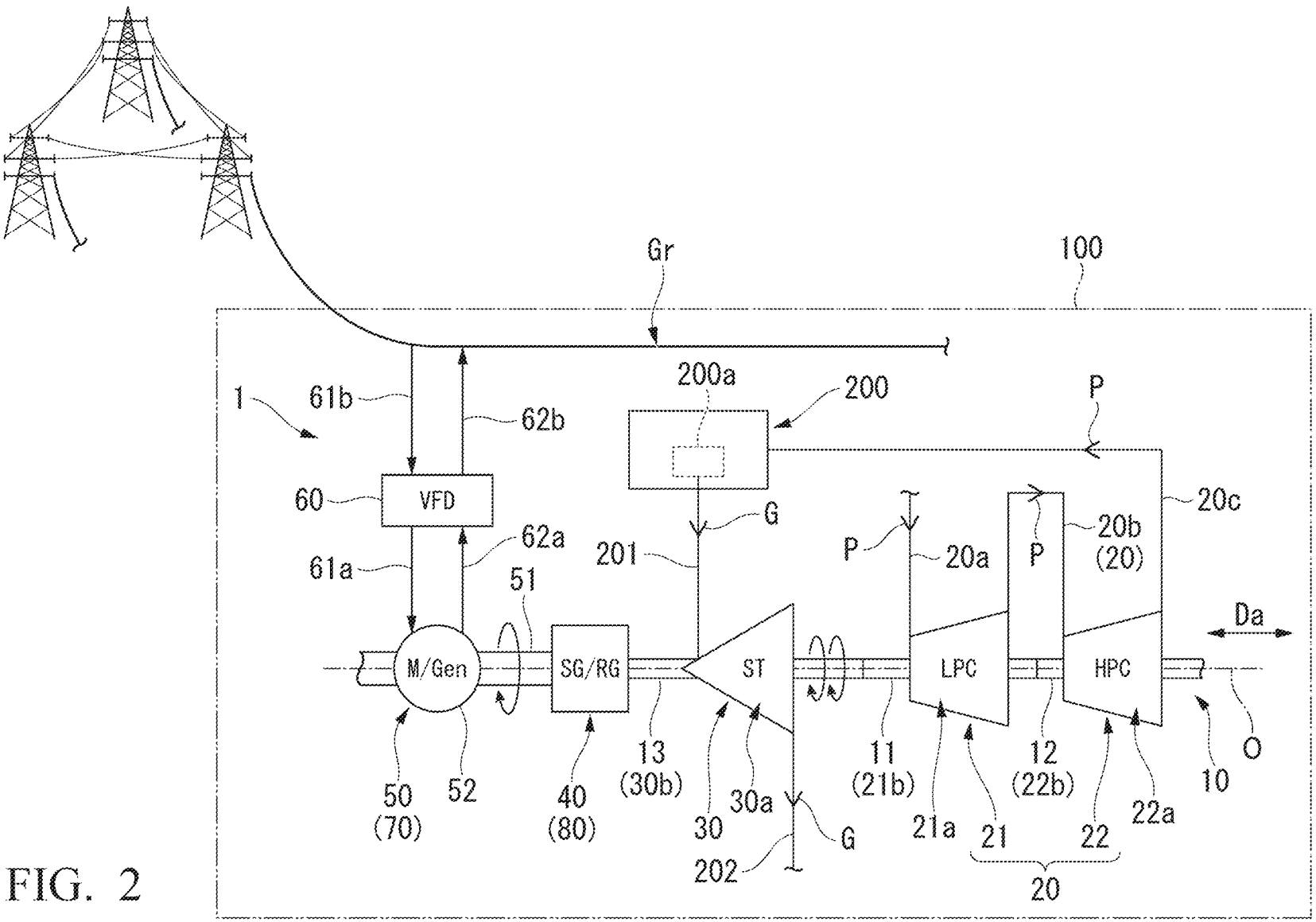
FIG. 2 is a schematic view showing a configuration of a compressor train for a chemical plant according to a second embodiment of the present disclosure.

Hereinafter, the compressor train 1 of chemical plants according to a second embodiment of the present disclosure will be described with reference to FIG. 2. The compressor train 1 of chemical plants described in the second embodiment has a partially different configuration from the compressor train 1 of chemical plants of the first embodiment. Components similar to those in the first embodiment are indicated by the same reference numerals and detailed descriptions are omitted.

(Motor)

The motor 50 (M/Gen: Motor/Generator) of this embodiment is an electric motor that can assist the rotation of the steam turbine 30 and a generator 70 that can generate regenerative power as the steam turbine 30 rotates. Specifically, as the output shaft 51 of the motor 50 rotates, the motor rotor of the motor body 52 rotates around the axis O. As the motor rotor rotates, induced electromotive force as regenerative power is generated in the coil of the motor stator.

When the amount of the steam G introduced into the steam turbine 30 exceeds a predetermined threshold value, the motor 50 does not function as the electric motor and switches to the generator 70. The predetermined threshold value of this embodiment means, for example, the upper limit value in the range of the amount of the steam introduced into the steam turbine 30 within a certain period of time required for the rated rotation of the compression unit 20.

The predetermined threshold value is calculated on the basis of, for example, the second pressure value of the process gas P in the compression unit 20 and the like. In this embodiment, the determination on whether the amount of the steam G introduced into the steam turbine 30 exceeds a predetermined threshold value is based on, for example, the detection result of the pressure of the process gas P passing through the compression unit 20 using a pressure sensor or the like provided inside the gas discharge line 20*c*.

(Speed Increaser)

The speed increaser 40 (SG/RG: Step-up Gear/Reduction Gear) of this embodiment is a device capable of increasing the rotational speed of the rotating shaft 10 more than the rotational speed of the motor 50 and is a speed reducer 80 capable of reducing the rotational speed of the motor 50 to a lower speed than the rotational speed of the rotating shaft 10. The speed increaser 40 switches to the speed reducer 80 when the motor 50 switches to the generator 70.

(Frequency Conversion Unit)

The frequency conversion unit 60 of this embodiment is an inverter that converts DC power supplied from the electric power system Gr into AC power and a converter that converts regenerative power, which is AC power generated by the coil of the motor stator in the motor 50, into DC power.

A first power selling cable 62*a* and a second power selling cable 62*b* are connected to the frequency conversion unit 60. The first power selling cable 62*a* electrically connects the frequency conversion unit 60 and the motor stator of the motor 50. The second power selling cable 62*b* electrically connects the frequency conversion unit 60 and the electric power system Gr.

The frequency conversion unit 60 stops receiving power supply from the electric power system Gr when the motor 50 switches to the generator 70. The frequency conversion unit 60 blocks the flow of current from the electric power system Gr through the second power purchasing cable 61*b*, for example, by switching the circuit.

On the other hand, regenerative power, which is AC power generated by the coil of the motor stator, is input to the frequency conversion unit 60 through the first power selling cable 62*a*.

Accordingly, the regenerative power, which is AC power input to the frequency conversion unit 60, is converted into DC power by a power module or the like included in the frequency conversion unit 60, and then input to the electric power system Gr through the second power selling cable 62*b*. Thus, the motor 50 as the generator 70 of this embodiment can sell the generated regenerative power to the electric power system Gr via the frequency conversion unit 60.

Operation and Effect

For example, when the speed of the chemical reaction inside the ammonia converter 200 increases, the amount of the steam G generated in the boiler 200*a* during a certain period of time increases, that is, the amount of the steam G introduced into the steam turbine 30 driving the compression unit 20 increases and exceeds a predetermined threshold value. Further, when it is desired to reduce the rated rotational speed (rated rotational speed) of the compression unit 20, the amount of the steam G introduced into the steam turbine 30 that drives the compression unit 20 may become excessive.

In the compressor train 1 of chemical plants according to the above embodiment, when the amount of the generated steam G exceeds a predetermined threshold value, the motor 50 does not function as the motor, and becomes the generator 70 that is rotationally driven by the steam turbine 30 to generate regenerative power.

Accordingly, regenerative power generated using the excess steam G can be sold to the electric power system Gr. That is, it is possible to partially offset the amount of power purchased from the electric power system Gr in order to drive the motor 50 as an auxiliary to the steam turbine 30. Thus, the power consumption of the compressor train 1 of chemical plants can be reduced and the cost of operating the compressor train 1 of chemical plants can be reduced.

Further, the power of the steam G excessively introduced into the steam turbine 30 can be used to rotationally drive the motor 50. Accordingly, when the steam turbine 30 rotates the turbine rotating shaft 13, the motor 50 and the speed increaser 40 act as resistance. Therefore, it is possible to suppress the rotational speed of the compression unit 20 driven by the steam turbine 30 from becoming higher than the rated rotational speed.

Third Embodiment

Figure 3:
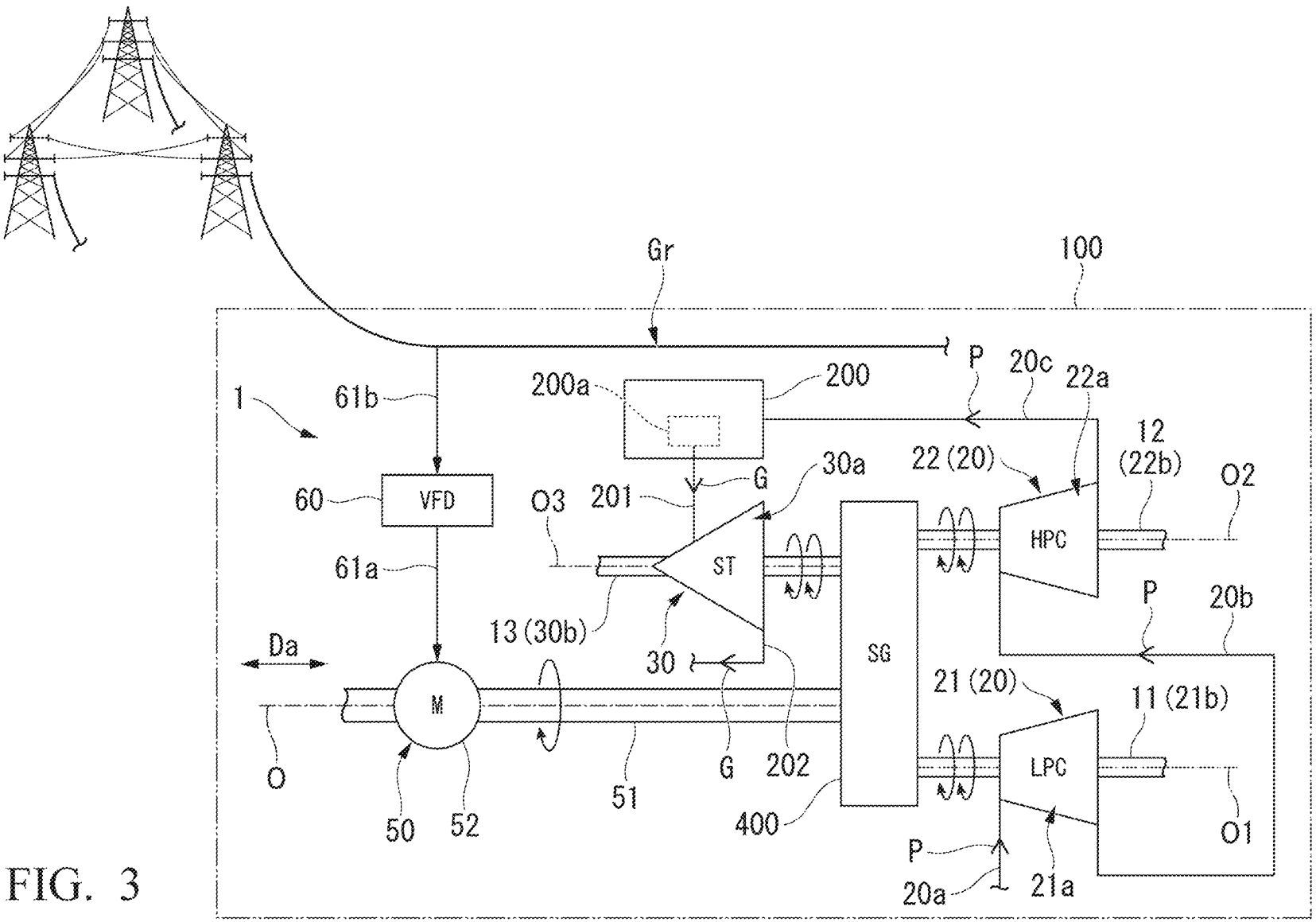
FIG. 3 is a schematic view showing a configuration of a compressor train for a chemical plant according to a third embodiment of the present disclosure.

Hereinafter, the compressor train 1 of chemical plants according to a third embodiment of the present disclosure will be described with reference to FIG. 3. The compressor train 1 of chemical plants described in the third embodiment has a partially different configuration from the compressor train 1 of chemical plants of the first embodiment. Components similar to those in the first embodiment are indicated by the same reference numerals and detailed descriptions are omitted.

(Compression Unit)

The first rotating shaft 11 of the low-pressure stage compressor 21 is connected to a speed increaser 400. The first rotating shaft 11 extends in the horizontal direction and is rotatable around a first axis O1 about the first axis O1 that is parallel to the axis O.

The second rotating shaft 12 of the high-pressure stage compressor 22 is connected to the speed increaser 400. The second rotating shaft 12 extends in the horizontal direction and is rotatable around a second axis O2 about the second axis O2 parallel to the axis O.

(Steam Turbine)

The turbine rotating shaft 13 of the steam turbine 30 is connected to the speed increaser 400. The turbine rotating shaft 13 extends in the horizontal direction and is rotatable around a turbine axis O3 about the turbine axis O3 parallel to the axis O.

The first axis O1, the second axis O2, and the turbine axis O3 of this embodiment are different axes. Thus, the first rotating shaft 11, the second rotating shaft 12, and the turbine rotating shaft 13 do not share the same axis as a center line.

(Speed Increaser)

The speed increaser 400 of this embodiment is a gear device (gear box) which connects the first rotating shaft 11 of the low-pressure stage compressor 21, the second rotating shaft 12 of the high-pressure stage compressor 22, the turbine rotating shaft 13 of the steam turbine 30, and the motor 50 and can increase the rotational speed of these motors to a higher speed than the rotational speed of the motor 50.

The speed increaser 400 includes parallel gears that can increase the rotational speeds of the first rotating shaft 11, the second rotating shaft 12, and the turbine rotating shaft 13 to different speeds. The parallel gears of this embodiment can increase the rotational speed to be higher than the rotational speed of the output shaft 51 of the motor 50 in the order of the turbine rotating shaft 13, the first rotating shaft 11, and the second rotating shaft 12.

The parallel gears include a plurality of gears. In the parallel gears, different gears can increase the rotational speeds of the first rotating shaft 11, the second rotating shaft 12, and the turbine rotating shaft 13. That is, the first rotating shaft 11, the second rotating shaft 12, and the turbine rotating shaft 13 are connected to the speed increaser 400 at positions shifted from each other.

The speed increaser 400 can be disconnected from the first rotating shaft 11 and the second rotating shaft 12 and can be connected only to the motor 50 and the turbine rotating shaft 13. Accordingly, when the steam turbine 30 starts operating (starting up), the motor 50 can only assist the driving of the steam turbine 30.

(Motor)

The output shaft 51 is a columnar member (motor shaft) that extends in the axial direction Da and is rotatable around the axis O. The end on one side in the axial direction Da of the output shaft 51 is connected to the speed increaser 400.

Here, the first rotating shaft 11, the second rotating shaft 12, and the turbine rotating shaft 13, and the output shaft 51 are separated from each other in the horizontal direction and the center line of the output shaft 51 and the center lines of the first rotating shaft 11, the second rotating shaft 12, and the turbine rotating shaft 13 do not overlap on the same straight line. That is, the first rotating shaft 11, the second rotating shaft 12, and the turbine rotating shaft 13 are eccentric with respect to the output shaft 51.

Operation and Effect

In the compressor train 1 of chemical plants according to the above embodiment, since the parallel gears of the speed increaser 400 can respectively increase the rotational speeds of the steam turbine 30, the low-pressure stage compressor 21, and the high-pressure stage compressor 22 to different rotational speeds, each rotational speed can be adjusted to the minimum required rotational speed.

Accordingly, for example, when compared with a configuration in which the speed increaser 400 increases the rotational speeds of the steam turbine 30, the low-pressure stage compressor 21, and the high-pressure stage compressor 22 all at once on the same axis, the total amount of energy required to drive these rotations can be reduced. Thus, it is possible to improve the energy efficiency and save energy of the compressor train 1 of chemical plants.

Further, in the compressor train 1 of chemical plants according to the above embodiment, the steam turbine 30 includes the turbine rotating shaft 13, the low-pressure stage compressor 21 includes the first rotating shaft 11, and the high-pressure stage compressor 22 includes the second rotating shaft 12. That is, the steam turbine 30, the low-pressure stage compressor 21, and the high-pressure stage compressor 22 respectively have different drive shafts.

Accordingly, when one of these devices is disassembled for maintenance, units or parts disassembled from one device will not interfere with other devices because these devices are not placed on the same axis. Thus, the maintainability of the compressor train 1 of chemical plants can be improved.

Fourth Embodiment

Hereinafter, the compressor train 1 of chemical plants and a method of operating the compressor train 1 of chemical plants according to a fourth embodiment of the present disclosure will be described with reference to FIGS. 4 to 8. The compressor train 1 of chemical plants described in the fourth embodiment has a partially different configuration from the compressor train 1 of chemical plants of the first embodiment. Components similar to those in the first embodiment are indicated by the same reference numerals and detailed descriptions are omitted.

(Compressor Train of Chemical Plants)

Figure 4:
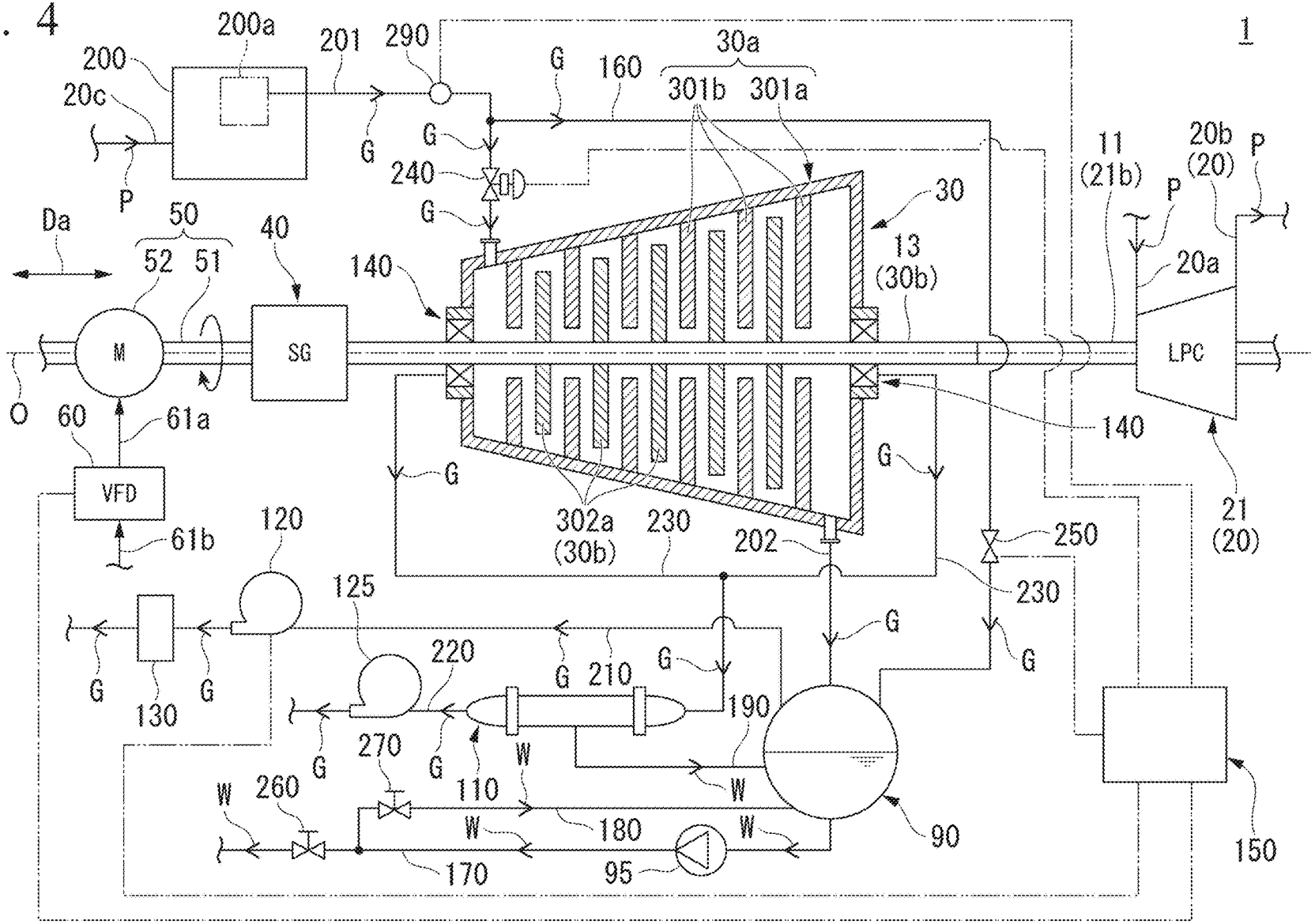
FIG. 4 is a diagram showing a main part (system) of a configuration of a compressor train for a chemical plant according to a fourth embodiment of the present disclosure.

As shown in FIG. 4, the compressor train 1 of chemical plants of this embodiment includes the compression unit 20 (the entire illustration is omitted), the steam turbine 30, the speed increaser 40, the motor 50, the frequency conversion unit 60, a condenser 90, a condensate pump 95, a ground condenser 110, a vacuum pump 120, a vapor fan 125, a drain separator 130, a shaft seal device 140, a control device 150, a steam introduction line 201, a steam discharge line 202, a connection line 160, a drainage line 170, a circulation line 180, a condensate recovery line 190, a first suction line 210, a second suction line 220, a leaked steam line 230, a governing valve 240, a dump valve 250, a first on-off valve 260, a second on-off valve 270, and a flow rate sensor 290.

(Steam Turbine)

The steam turbine 30 includes a turbine stator 30*a* (stator) and a turbine rotor 30*b* (rotor).

The turbine stator 30*a* includes a turbine casing 301*a* that allows the steam G to flow therein and a plurality of stages of stator vanes 301*b* which extend inward from the inner surface of the turbine casing 301*a* and rectify the flow of the steam G as a working fluid.

The turbine casing 301*a* forms the outer shell of the steam turbine 30. The turbine casing 301*a* includes a turbine casing body, a steam inlet formed in the turbine casing body to introduce the steam G, and a steam outlet formed in the turbine casing body to discharge the steam G. The stator vane 301*b* extends inward from the inner surface of the turbine casing body. The stator vane 301*b* rectifies the flow of the steam G as a working fluid inside the turbine casing body.

The turbine rotor 30*b* includes the turbine rotating shaft 13 and a plurality of rotor blades 302*a* which are fixed to the turbine rotating shaft 13 and collide with the steam G rectified by the stator vanes 301*b* of the turbine stator 30*a* to rotate around the axis O together with the turbine rotating shaft 13.

The rotor blades 302*a* are accommodated in the turbine casing body. The rotor blades 302*a* are integrally formed with the turbine rotating shaft 13 and extend outward from the outer surface of the turbine rotating shaft 13. The rotor blades 302*a* receive pressure as a rotational force for rotating the turbine rotating shaft 13 from the steam G inside the turbine casing body.

The turbine rotor 30*b* forms a flow path of the steam G together with the inner surface of the turbine casing body of the turbine casing 301*a* and the surface of the stator vane 301*b*. These stator vanes 301*b* and rotor blades 302*a* are alternately arranged in the axial direction Da.

The flow of the steam G introduced into the steam turbine 30 will be described below. The steam G introduced into the turbine casing body through the steam inlet connected to the steam introduction line 201 is rectified by the stator vanes 301*b* and collides with the rotor blade 302*a* in the last stage to rotate the rotor blade 302*a* around the axis O. The steam G colliding with the rotor blades 302*a* is rectified again by the stator vane 301*b* in the last stage and then collides with the rotor blade 302*a* in the last stage.

The steam G introduced into the turbine stator 30*a* continues to rotate the turbine rotor 30*b* by repeating rectification by the stator vanes 301*b* and collision with the rotor blades 302*a*. That is, the steam G introduced into the steam turbine 30 continues to rotate the turbine rotating shaft 13 of the turbine rotor 30*b*.

After the steam G collides with the rotor blade 302*a* in the last stage, the steam is discharged to the outside of the steam turbine 30 through the steam outlet of the turbine casing 301*a*. The steam discharge line 202 which is a pipe for discharging the steam G is connected to the steam outlet and the steam G is introduced into the condenser 90 disposed outside the steam turbine 30 through the steam discharge line 202.

(Condenser)

The condenser 90 is connected to the steam turbine 30 by, for example, the steam discharge line 202. The condenser 90 cools and condenses the steam G discharged from the steam outlet of the turbine casing 301*a* through the steam discharge line 202. The condenser 90 is connected to the drainage line 170. The condenser 90 discharges the water W accumulated therein to the outside of the condenser 90 through the drainage line 170.

Further, the condenser 90 is connected to the first suction line 210. The condenser 90 discharges air flowing from gaps such as equipment joints to the outside of the condenser 90 from this first suction line 210. Further, the condenser 90 is connected to the circulation line 180. Further, the circulation line 180 is connected to the drainage line 170.

Further, the connection line 160 is connected to the condenser 90. The connection line 160 connects the steam introduction line 201 and the condenser 90. Therefore, the connection line 160 can guide the steam G flowing toward the steam turbine 30 through the steam introduction line 201 to the condenser 90. Further, the dump valve 250 is disposed in the connection line 160. The dump valve 250 adjusts its own opening degree by receiving a signal indicating the opening degree transmitted from the control device 150. The dump valve 250 reduces the pressure of the steam G flowing through the connection line 160 to a pressure corresponding to the opening degree.

Further, the governing valve 240 is disposed at a position closer to the steam turbine 30 than the connection point with the connection line 160 in the steam introduction line 201. The governing valve 240 adjusts its own opening degree by receiving a signal indicating the opening degree transmitted from the control device 150. Further, the flow rate sensor 290 is disposed at a position closer to the ammonia converter 200 than the connection point with connection line 160 in the steam introduction line 201. The flow rate sensor 290 detects the amount of the steam G flowing through the steam introduction line 201. The flow rate sensor 290 transmits a signal indicating the detected amount of the steam G to the control device 150.

(Condensate Pump)

The condensate pump 95 is disposed in the drainage line 170. The condensate pump 95 circulates the water W condensed in the condenser 90 through this drainage line 170 to external equipment (not shown) such as a boiler. The first on-off valve 260 is disposed at a portion of the drainage line 170 on the downstream side of the condensate pump 95. Further, the circulation line 180 connecting the drainage line 170 and the condenser 90 is connected to the drainage line 170.

The first on-off valve 260 is disposed on the downstream side of the connection point with the circulation line 180 in the drainage line 170. Further, the second on-off valve 270 is disposed in the circulation line 180. By adjusting the opening degrees of the first on-off valve 260 and the second on-off valve 270, the amount of the water W flowing into the boiler from the condenser 90 and the amount of the water W returning to the condenser 90 are adjusted.

(Ground Condenser)

The ground condenser 110 is connected to the steam turbine 30, for example, through the leaked steam line 230. The ground condenser 110 deaerates leaked steam that has flowed out of the turbine stator 30*a* from the gap between the turbine stator 30*a* and the turbine rotor 30*b* of the steam turbine 30. The ground condenser 110 of this embodiment condenses leaked steam (ground steam) leaking from a gap between the turbine rotating shaft 13 of the turbine rotor 30*b* and openings formed at both ends of the casing body of the turbine stator 30*a* in the axial direction Da.

Therefore, the inside of the ground condenser 110 communicates with the gap between the turbine rotating shaft 13 and the opening of the casing body through the leaked steam line 230. The ground condenser 110 of this embodiment is, for example, a shell-and-tube heat exchanger.

The ground condenser 110 is connected to the condenser 90 through the condensate recovery line 190. The ground condenser 110 supplies starting water W to the condenser 90 when the steam turbine 30 is started. The ground condenser 110 supplies the water W obtained by deaerating leaked steam and condensed water W during operation of the steam turbine 30 to the condenser 90 through the condensate recovery line 190. Accordingly, the ground condenser 110 controls the liquid level of the condenser 90 when the steam turbine 30 is operated.

(Vacuum Pump)

The vacuum pump 120 is connected to the condenser 90 through the first suction line 210.

The vacuum pump 120 is driven to suck air inside the condenser 90. Accordingly, the vacuum pump 120 reduces the pressure inside the condenser 90 to negative pressure. When the steam turbine 30 is not driven, the vacuum pump 120 is driven so that air inside the condenser 90 is sucked and air inside the steam turbine 30 is sucked to the condenser 90 through the steam discharge line 202. As a result, the pressure inside the steam turbine 30 is reduced.

The drain separator 130 is disposed in the first suction line 210 on the downstream side of the vacuum pump 120. This drain separator 130 further separates the air sucked by the vacuum pump 120 into gas and liquid. For example, the liquid phase component and the gas phase component separated into gas and liquid by the drain separator 130 are discharged to the outside of the compressor train 1 of chemical plants.

(Vapor Fan)

The vapor fan 125 is disposed in the second suction line 220 connected to the ground condenser. The vapor fan 125 is electrically driven to remove the air inside the ground condenser 110 and maintain the inside of the ground condenser 110 at a slightly negative pressure.

(Shaft Seal Device)

The shaft seal device 140 seals a gap between the turbine stator 30*a* of the steam turbine 30 and the turbine rotor 30*b* of the steam turbine 30. The shaft seal devices 140 of this embodiment are arranged in the gaps between the turbine rotating shaft 13 and openings formed at both ends of the casing body. Accordingly, the shaft seal device 140 seals a gap between the opening and the outer peripheral surface of the turbine rotating shaft 13 to suppress leakage of the steam G from the casing body to the outside.

Figure 5:
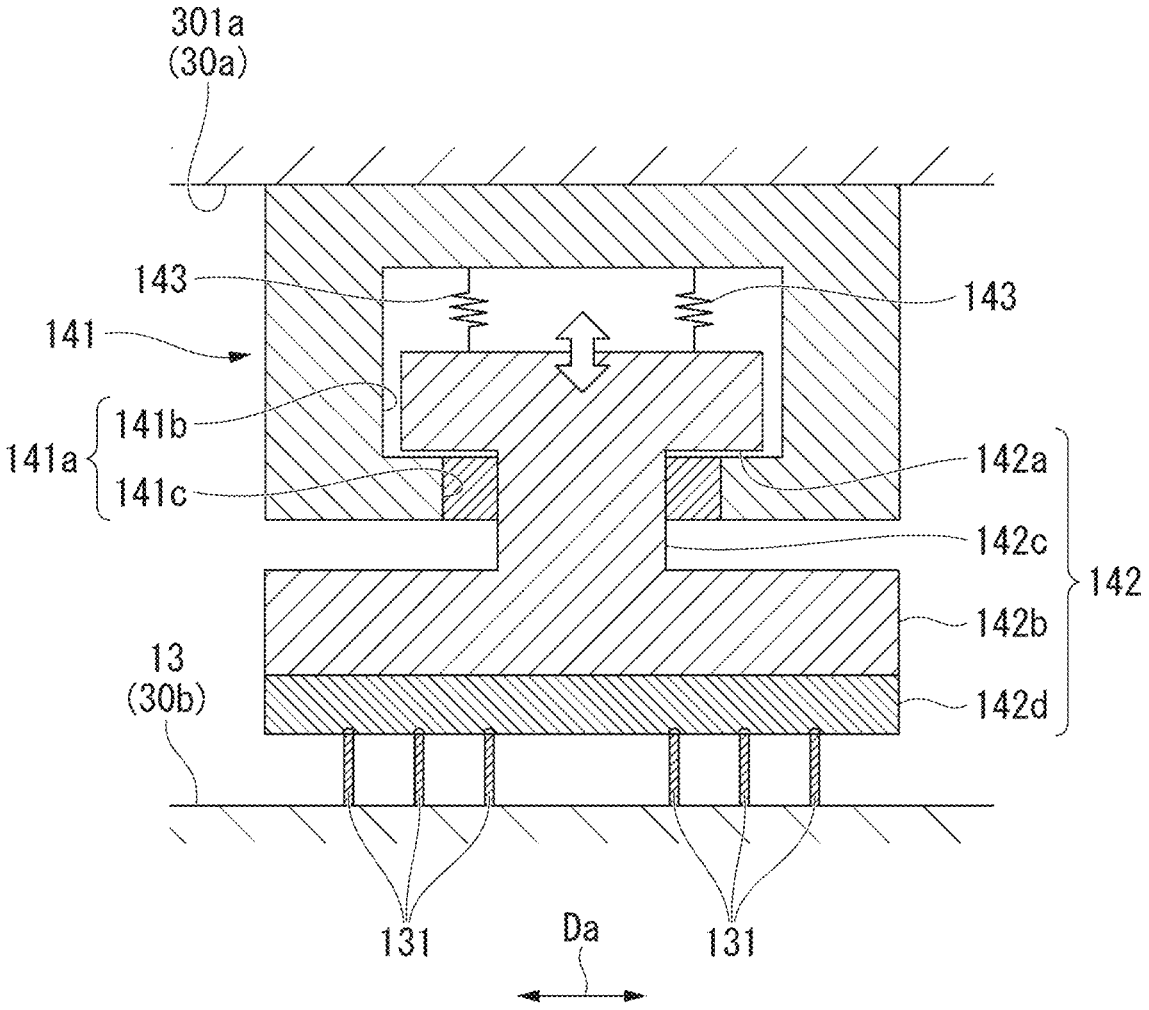
FIG. 5 is a diagram showing a configuration of a shaft seal device according to the fourth embodiment of the present disclosure.

The shaft seal device 140 is connected to the ground condenser 110 through the leaked steam line 230. The shaft seal device 140 of this embodiment is placed in an atmospheric pressure environment facing the outside of the casing. As shown in FIG. 5, the shaft seal device 140 of this embodiment includes a housing 141, a seal member 142, and a biasing member 143.

The housing 141 is fixed within the opening of the casing body. A groove 141*a* is formed in the housing 141 and extends continuously in the circumferential direction around the axis O of the turbine rotating shaft 13. The groove 141*a* includes an accommodation recess 141*b* having a rectangular cross section, and a communication portion 141*c* that communicates the accommodation recess 141*b* and the space between the turbine rotating shaft 13 and the housing 141 with each other. The housing 141 holds the seal member 142 movably in the radial direction of the turbine rotating shaft 13 within the accommodation recess 141*b*.

The seal member 142 is movable in its radial position relative to the outer peripheral surface of the turbine rotating shaft 13. Furthermore, the seal member 142 is movable relative to the housing 141 in the radial direction. The seal member 142 of this embodiment has an annular shape. The seal member 142 includes a pressure receiving portion 142*a*, a base portion 142*b*, a connection portion 142*c*, and a seal body 142*d*.

The pressure receiving portion 142*a* is accommodated in the accommodation recess 141*b* to be movable in the radial direction. The pressure receiving portion 142*a* is connected to the seal body 142*d* through the base portion 142*b* and the connection portion 142*c*. The pressure receiving portion 142*a* moves the seal body 142*d* in the radial direction. The pressure receiving portion 142*a* is formed so that the width dimension in the axial direction Da is smaller than the width dimension of the accommodation recess 141*b* in the axial direction Da and is larger than the width dimension of the connection portion 142*c* in the axial direction Da.

The base portion 142*b* is disposed on the inside of the housing 141 in the radial direction. The width dimension of the base portion 142*b* in the axial direction Da is larger than the width dimension of the communication portion 141*c* in the axial direction Da. The width dimension of the base portion 142*b* in the axial direction Da of this embodiment is substantially the same as the width dimension of the housing 141 in the axial direction Da.

The connection portion 142*c* connects the pressure receiving portion 142*a* and the base portion 142*b* to each other. The connection portion 142*c* is movable in the radial direction inside the communication portion 141*c* of the groove 141*a*.

The seal body 142*d* seals a gap with respect to the outer peripheral surface of the turbine rotating shaft 13. The seal body 142*d* is fixed to the radially inner portion of the base portion 142*b*. The inner peripheral surface of the seal body 142*d* can come into contact with the turbine rotating shaft 13. The seal body 142*d* has a free-cutting material made of a material with higher machinability than the turbine rotating shaft 13. For example, the seal body 142*d* of this embodiment is formed of an abradable material. Furthermore, the seal body 142*d* is not limited to an abradable material, but may include a free-cutting material. The seal body 142*d* may contain, for example, a carbon material.

Further, in this embodiment, a plurality of seal protrusions 131 are formed in a region of the outer peripheral surface of the turbine rotating shaft 13 corresponding to a region in which the shaft seal device 140 is disposed. The plurality of seal protrusions 131 are formed on the outer peripheral surface of the turbine rotating shaft 13 facing the seal body 142*d* to be separated from each other in the axial direction Da. The seal protrusion 131 is integrally formed with the turbine rotating shaft 13. The seal protrusion 131 protrudes radially outward from the outer peripheral surface of the turbine rotating shaft 13. The seal body 142*d* exhibits sealing properties by slidingly contacting the seal protrusion 131 rotating in a scraped state.

The biasing member 143 biases the pressure receiving portion 142*a* radially inward. The plurality of biasing members 143 are arranged in the accommodation recess 141*b* while being connected to the pressure receiving portion 142*a*. The biasing member 143 is, for example, an elastic member such as a disc spring or a plate spring. The biasing member 143 compresses by pressing the pressure receiving portion 142*a* radially inward and receiving force from the pressure receiving portion 142*a* radially outward.

In such a shaft seal device 140, the pressure receiving portion 142*a* is pressed radially inward by the biasing force of the biasing member 143. As a result, the seal body 142*d* approaches the outer peripheral surface of the turbine rotating shaft 13 and the seal body 142*d* comes into sliding contact with the seal protrusion 131. Accordingly, a gap between the opening of the casing body and the turbine rotating shaft 13 is sealed by the shaft seal device 140 and air entry from the outside of the casing body into the casing body is prevented. That is, when the steam turbine 30 is driven, the pressure receiving portion 142*a* is pressed radially inward by the biasing force of the biasing member 143 and the gap between the turbine rotating shaft 13 and the opening of the casing body is sealed.

(Control Device)

Figure 6:
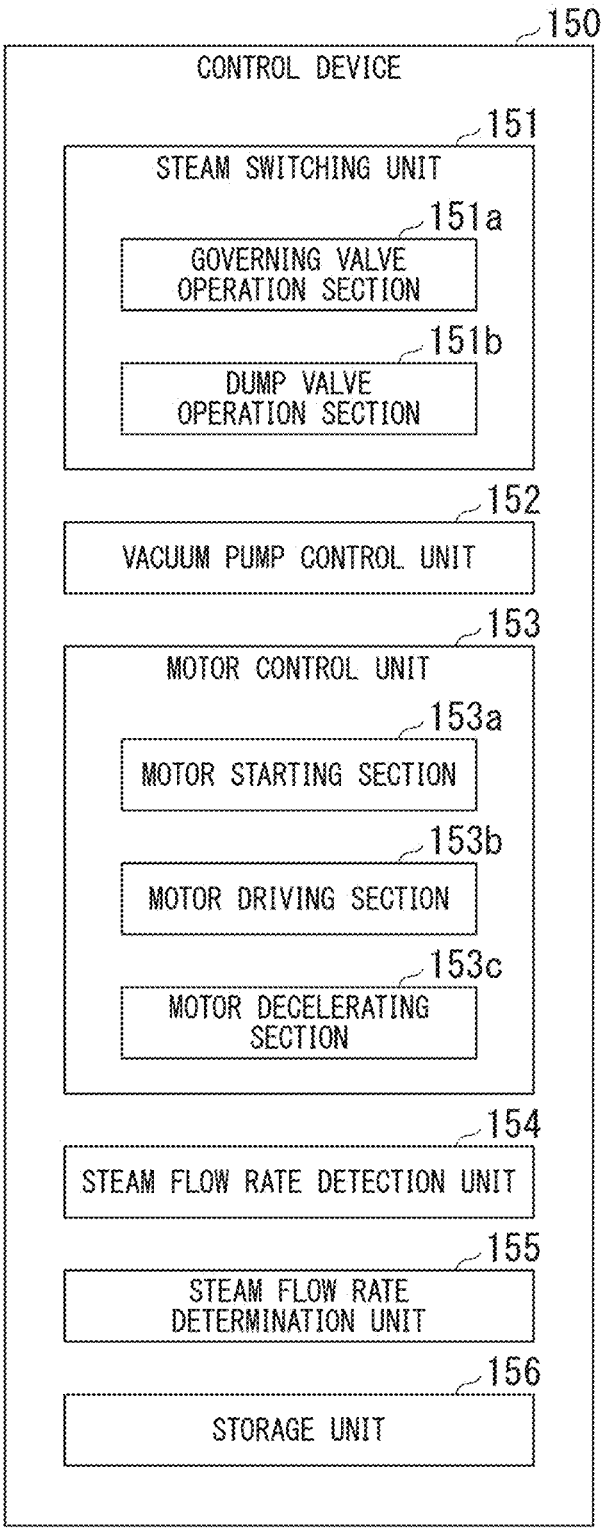
FIG. 6 is a flowchart showing a method of operating the compressor train of chemical plants according to the fourth embodiment of the present disclosure.

The control device 150 controls the operating status of the steam turbine 30. As shown in FIG. 6, the control device 150 of this embodiment includes a steam switching unit 151, a vacuum pump control unit 152, a motor control unit 153, a steam flow rate detection unit 154, a steam flow rate determination unit 155, and a storage unit 156.

(Steam Switching Unit)

The steam switching unit 151 operates each of the opening degree of the governing valve 240 disposed in the steam introduction line 201 and the opening degree of the dump valve 250 disposed in the connection line 160. The steam switching unit 151 includes a governing valve operation section 151*a* and a dump valve operation section 151*b*.

The governing valve operation section 151*a* operates the opening degree of the governing valve 240 by transmitting a signal indicating the opening degree to the governing valve 240. The dump valve operation section 151*b* operates the opening degree of the dump valve 250 by transmitting a signal indicating the opening degree to the dump valve 250.

(Vacuum Pump Control Unit)

The vacuum pump control unit 152 drives the vacuum pump 120. Specifically, the vacuum pump control unit 152 drives the vacuum pump 120 by transmitting a signal indicating a drive instruction to the vacuum pump 120.

(Motor Control Unit)

The motor control unit 153 controls the driving of the motor 50 during operation of the steam turbine 30 including starting and stopping the steam turbine 30. The motor control unit 153 includes a motor starting section 153*a*, a motor driving section 153*b*, and a motor decelerating section 153*c*.

The motor starting section 153*a* starts the driving of the motor 50 when a signal indicating a starting instruction is input. Specifically, when a signal indicating a starting instruction is input to the control device 150 via an input interface or the like by an operator or the like of the compressor train 1 of chemical plants, the motor starting section 153*a* starts the driving of the motor 50 by transmitting a signal indicating a starting instruction to the frequency conversion unit 60. When the frequency conversion unit 60 receives a signal transmitted from the motor starting section 153*a*, AC power of a predetermined magnitude is input to the motor 50 through the first power purchasing cable 61*a*. Accordingly, the motor 50 starts to be driven. That is, the output shaft 51 of the motor 50 starts to rotate around the axis O by applying an alternating voltage to the motor body 52 of the motor 50.

The motor driving section 153*b* continues to drive the motor 50 when the motor starting section 153*a* starts the driving of the motor 50. Specifically, the motor driving section 153*b* continues to drive the motor 50 by transmitting a signal indicating a predetermined rotational speed to the frequency conversion unit 60. When the frequency conversion unit 60 receives a signal transmitted from the motor driving section 153*b*, AC power of a magnitude corresponding to the rotational speed indicated by the received signal is input to the motor 50 through the first power purchasing cable 61*a*. Accordingly, the motor 50 continues to rotate at a rotational speed according to the signal. Furthermore, the rotational speed indicated by a signal transmitted from the motor driving section 153*b* to the frequency conversion unit 60 is stored in advance, for example, in the storage unit 156. The rotational speed of this embodiment includes, for example, the rated rotational speed of the motor 50.

The motor decelerating section 153*c* decelerates the motor 50 when, for example, a signal indicating a stop instruction is input while the motor 50 is driven and maintained by the motor driving section 153*b*. Specifically, when a signal indicating a stop instruction is input to the control device 150 through an input interface or the like by the operator or the like of the compressor train 1 of chemical plants, the motor decelerating section 153*c* decelerates the motor 50 by transmitting a signal indicating deceleration to the frequency conversion unit 60. When the frequency conversion unit 60 of this embodiment receives a signal transmitted from the motor decelerating section 153*c*, the input of AC power to the motor 50 through the first power purchasing cable 61*a* is stopped. Accordingly, the motor 50 gradually decelerates (the rotational speed decreases).

(Steam Flow Rate Detection Unit)

The steam flow rate detection unit 154 detects the amount of the steam G flowing through the steam introduction line 201. Specifically, the steam flow rate detection unit 154 detects the amount of the steam G by receiving a signal indicating the detection result transmitted from the flow rate sensor 290 disposed in the steam introduction line 201. The steam flow rate detection unit 154 transmits a signal indicating the detected amount of the steam G to the steam flow rate determination unit 155.

(Steam Flow Rate Determination Unit)

The steam flow rate determination unit 155 determines whether the amount of the steam G flowing through the steam introduction line 201 is equal to or larger than a specified amount. Specifically, it is determined whether the amount of the steam G flowing through the steam introduction line 201 is equal to or larger than a specified amount by comparing the amount of the steam G received from the steam flow rate detection unit 154 with a predetermined specified amount stored in advance in the storage unit 156.

That is, when the amount of the steam G received from the steam flow rate detection unit 154 is smaller than the specified amount, the steam flow rate determination unit 155 determines that "the amount of steam is smaller than the specified amount". On the other hand, when the amount of the steam G received from the steam flow rate detection unit 154 is equal to or larger than the specified amount, the steam flow rate determination unit 155 determines that "the amount of steam is equal to or larger than the specified amount". The steam flow rate determination unit 155 transmits a signal indicating the determination result to the steam switching unit 151.

The specified amount of this embodiment means, for example, the lower limit (minimum cooling steam flow) in the range of the amount of the steam G that does not cause the internal temperature of the steam turbine 30 to rise excessively when the steam G flows into the steam turbine 30 to drive the steam turbine 30 while the inside of the steam turbine 30 is depressurized by the vacuum pump 120. This specified amount is a value smaller than the rated amount of the steam flowing into the steam turbine 30 during rated operation of the steam turbine 30. The specified amount is stored in advance, for example, in the storage unit 156.

Here, when the steam switching unit 151 receives the determination result from the steam flow rate determination unit 155, the opening and closing states of the governing valve 240 and the dump valve 250 are switched on the basis of the determination result. Specifically, the steam switching unit 151 closes the governing valve 240 and opens the dump valve 250 when the determination result indicates that "the steam amount is smaller than the specified amount". On the other hand, the steam switching unit 151 opens the governing valve 240 and closes the dump valve 250 when the determination result indicates that "the steam amount is equal to or larger than the specified amount".

At this time, the steam switching unit 151 gradually changes the opening degrees of the governing valve 240 and the dump valve 250. That is, the steam switching unit 151 gradually increases or decreases the opening degrees of the governing valve 240 and the dump valve 250. The steam switching unit 151 of this embodiment switches the opening and closing states of the governing valve 240 and the dump valve 250, for example, by linearly increasing or decreasing the opening degrees of the governing valve 240 and the dump valve 250.

(Method of Operating Compressor Train of Chemical Plants)

Figure 7:
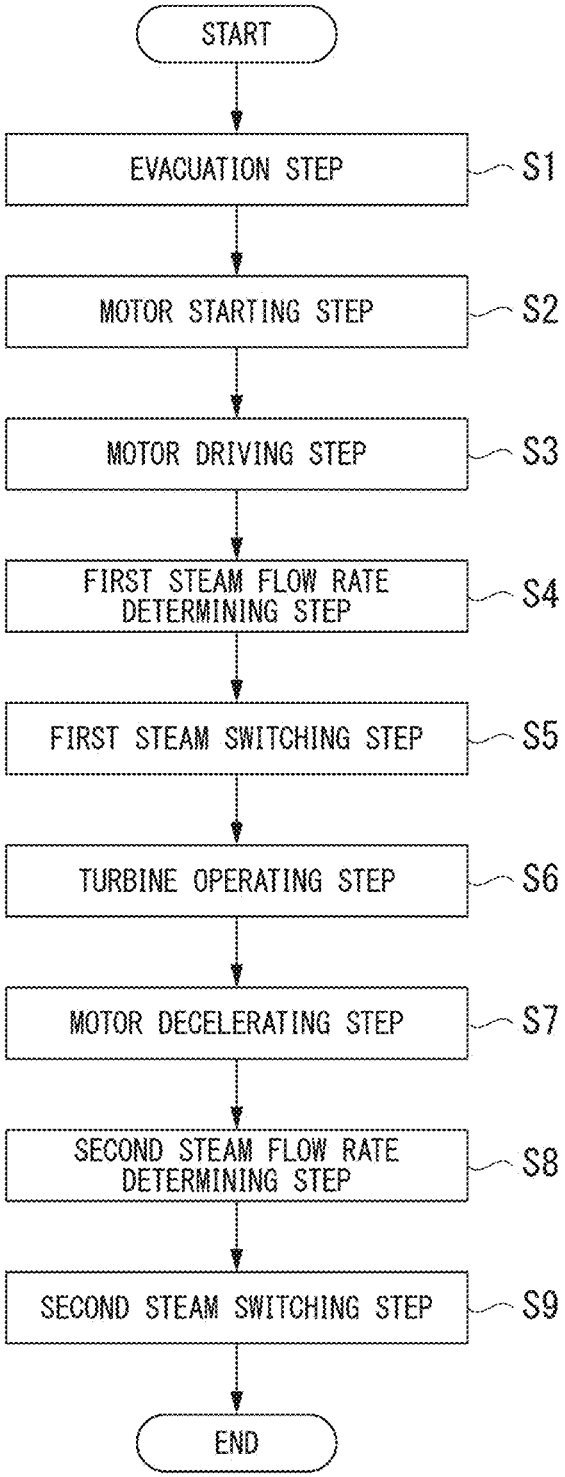
FIG. 7 is a functional block diagram of a control device according to the fourth embodiment of the present disclosure.

Next, a method of operating the compressor train 1 of chemical plants will be described with reference to FIG. 7. In the method of operating the compressor train 1 of chemical plants of this embodiment, an evacuation step S1, a motor starting step S2, a motor driving step S3, a first steam flow rate determining step S4, a first steam switching step S5, a turbine operating step S6, a motor decelerating step S7, a second steam flow rate determining step S8, and a second steam switching step S9 are performed.

(Evacuation Step)

In the evacuation step S1, the pressure inside the steam turbine 30 is reduced by driving the vacuum pump 120 while the steam turbine 30 is not driven. That is, the inside of the steam turbine 30 is evacuated. At this time, the inside of the steam turbine 30 is evacuated while the inflow of the steam G generated due to the processing of the process gas P into the steam turbine 30 is stopped. That is, the inside of the steam turbine 30 is evacuated with the governing valve 240 in the closed state and the dump valve 250 in the open state. Therefore, the governing valve 240 is closed, and the inside of the steam turbine 30 is evacuated with the steam G and air suppressed from flowing into the steam turbine 30 from the outside.

(Motor Starting Step)

The motor starting step S2 is a step performed after the evacuation step S1 is completed. In the motor starting step S2, the motor 50 is started by inputting AC power from the frequency conversion unit 60 to the motor 50. Therefore, in the motor starting step S2, the motor 50 starts to start, and the steam turbine 30 starts to drive. At this time, the motor 50 is started to be driven while the steam G generated due to the processing of the process gas P is stopped from flowing into the steam turbine 30.

(Motor Driving Step)

The motor driving step S3 is a step performed after the motor starting step S2 is completed. In the motor driving step S3, the motor 50 continues to drive by continuing to input AC power from the frequency conversion unit 60 to the motor 50. Thus, in the motor driving step S3, the steam turbine 30 continues to drive by maintaining the driving of the motor 50.

(First Steam Flow Rate Determining Step)

In the first steam flow rate determining step S4, the amount of the steam G generated as the motor 50 is driven is compared with a specified amount while the motor 50 continues to drive. In the first steam flow rate determining step S4, the amount of the steam G flowing through the steam introduction line 201 is detected and it is determined whether the amount of the steam G flowing through the steam introduction line 201 is equal to or larger than a specified amount.

(First Steam Switching Step)

The first steam switching step S5 is a step performed after the first steam flow rate determining step S4. In the first steam switching step S5, the flow of the steam G into the steam turbine 30 is started on the basis of the result determined in the first steam flow rate determining step S4. In the first steam switching step S5, when the amount of the steam G generated as the motor 50 is driven exceeds a specified amount, the steam G starts flowing into the steam turbine 30. That is, in the first steam switching step S5, the governing valve 240 is switched to the open state, and the dump valve 250 is switched to the closed state. At this time, the opening and closing states of the governing valve 240 and the dump valve 250 are switched by gradually changing the opening degrees of the governing valve 240 and the dump valve 250.

(Turbine Operating Step)

The turbine operating step S6 is a step performed after the first steam switching step S5. In the turbine operating step S6, the motor 50 continues to drive by continuing to input AC power from the frequency conversion unit 60 to the motor 50. Thus, in the turbine operating step S6, the steam turbine 30 continues to drive by maintaining the driving of the motor 50. In the turbine operating step S6 of this embodiment, for example, the motor 50 continues to drive at the rated rotational speed (operated at the rated speed).

(Motor Decelerating Step)

In the motor decelerating step S7, the rotation of the motor 50 is decelerated. In the motor decelerating step S7, for example, when the operator or the like of the compressor train 1 of chemical plants instructs to stop the steam turbine 30, the rotation of the motor 50 is decelerated. In the motor decelerating step S7 of this embodiment, the rotation of the motor 50 is decelerated and the driving of the motor 50 is stopped by not inputting AC power from the frequency conversion unit 60 to the motor 50.

(Second Steam Flow Rate Determining Step)

In the second steam flow rate determining step S8, when the rotation of the motor 50 is decelerated, the amount of the steam G generated as the motor 50 is driven is compared with a specified amount. In the second steam flow rate determining step S8, the amount of the steam G flowing through the steam introduction line 201 is detected and it is determined whether the amount of the steam G flowing through the steam introduction line 201 is smaller than a specified amount.

(Second Steam Switching Step)

The second steam switching step S9 is a step performed after the second steam flow rate determining step S8. In the second steam switching step S9, the flow of the steam G into the steam turbine 30 is stopped on the basis of the result determined in the second steam flow rate determining step S8. In the second steam switching step S9, when the amount of the steam G generated as the motor 50 is driven is smaller than a specified amount, the flow of the steam G into the steam turbine 30 is stopped. That is, in the second steam switching step S9, the governing valve 240 is switched to the closed state and the dump valve 250 is switched to the open state. At this time, the opening and closing states of the governing valve 240 and the dump valve 250 are switched by gradually changing the opening degrees of the governing valve 240 and the dump valve 250.

Further, in the second steam switching step S9, the pressure inside the steam turbine 30 is reduced by driving the vacuum pump 120 again after switching the opening and closing states of the governing valve 240 and the dump valve 250.

By performing each of the steps (S1 to S9) described above, the compressor train 1 of chemical plants is operated.

(Operation of Control Device)

Figure 8:
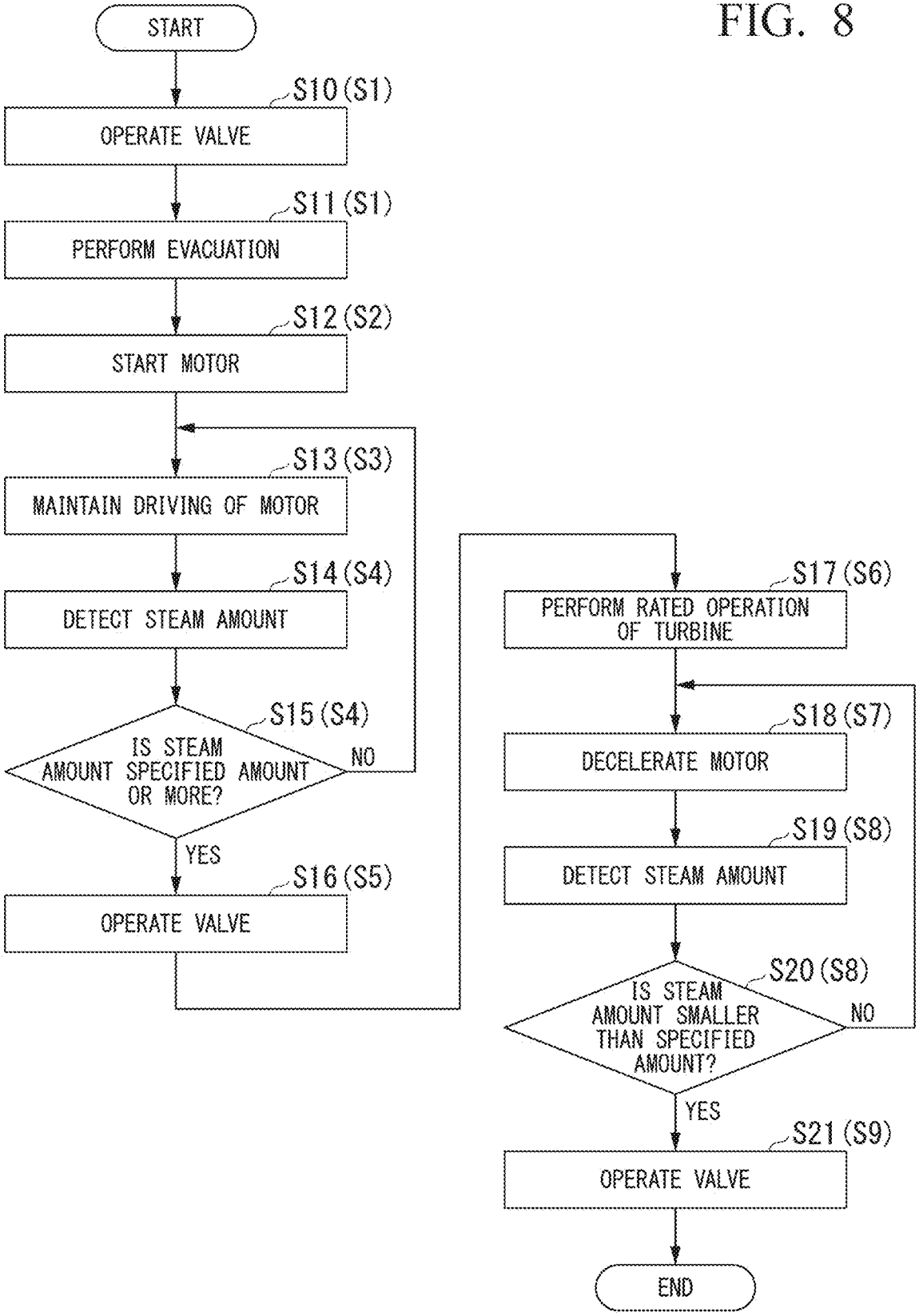
FIG. 8 is a flowchart showing an operation of the control device according to the fourth embodiment of the present disclosure.

Next, the operation of the control device 150 will be described with reference to FIG. 8.

First, in the evacuation step S1, the steam switching unit 151 of the control device 150 sets the opening and closing states of the governing valve 240 and the dump valve 250 by operating the governing valve 240 and the dump valve 250 (step S10). Specifically, the steam switching unit 151 switches the governing valve 240 to the closed state and switches the dump valve 250 to the open state.

Next, in the evacuation step S1, the vacuum pump driving unit of the control device 150 drives the vacuum pump 120 (step S11). Specifically, the vacuum pump driving unit drives the vacuum pump 120 by transmitting a signal indicating a drive instruction to the vacuum pump 120.

Next, in the motor starting step S2, the motor starting section 153*a* of the control device 150 starts the starting of the motor 50 (step S12). Specifically, the motor starting section 153*a* starts the driving of the motor 50 by transmitting a signal indicating a starting instruction to the frequency conversion unit 60.

Next, in the motor driving step S3, the motor driving section 153*b* of the control device 150 maintains the driving of the motor 50 (step S13). Specifically, the motor driving section 153*b* continues to drive the motor 50 by transmitting a signal indicating a predetermined rotational speed to the frequency conversion unit 60. That is, the driving of the motor 50 is maintained by the motor driving section 153*b*.

Next, in the first steam flow rate detecting step S4, the steam flow rate detection unit 154 of the control device 150 detects the amount of the steam G flowing through the steam introduction line 201 (step S14). Specifically, the steam flow rate detection unit 154 detects the amount of the steam G flowing through the steam introduction line 201 by receiving a signal transmitted from the flow rate sensor 290.

Next, in the first steam flow rate detecting step S4, the steam flow rate determination unit 155 of the control device 150 determines whether the amount of the steam G is equal to or larger than a specified amount on the basis of the amount of the steam G detected by the steam flow rate detection unit 154 (step S15). When the steam flow rate determination unit 155 determines that "the steam amount is smaller than the specified amount" (step S15: NO), for example, the routine returns to the process of step S14.

On the other hand, when the steam flow rate determination unit 155 determines that "the steam amount is equal to or larger than the specified amount" (step S15: YES), in the first steam switching step S5, the steam switching unit 151 switches the opening and closing states of the governing valve 240 and the dump valve 250 by operating the governing valve 240 and the dump valve 250 (step S16). Specifically, the steam switching unit 151 switches the governing valve 240 to the open state and switches the dump valve 250 to the closed state.

Next, in the turbine operating step S6, the motor driving section 153*b* maintains the driving of the motor 50 (step S17). Specifically, the motor driving section 153*b* continues to drive the motor 50 by transmitting a signal indicating a predetermined rotational speed to the frequency conversion unit 60. At this time, the motor driving section 153*b* transmits a signal indicating the rated rotational speed to the frequency conversion unit 60 so that the steam turbine 30 is driven at the rated rotational speed by driving the motor 50. Thus, the motor driving section 153*b* operates the steam turbine 30 at a rated operation.

Next, in the motor decelerating step S7, the motor decelerating section 153*c* of the control device 150 decelerates the motor 50 when a signal indicating a stop instruction of the steam turbine 30 is input by the operator or the like of the compressor train 1 of chemical plants (step S18). Specifically, the motor decelerating section 153*c* decelerates the motor 50 by transmitting a signal indicating deceleration to the frequency conversion unit 60.

Next, in the second steam flow rate determining step S8, the steam flow rate detection unit 154 detects the amount of the steam G flowing through the steam introduction line 201 when the motor 50 is decelerated (step S19). Specifically, the steam flow rate detection unit 154 detects the amount of the steam G flowing through the steam introduction line 201 by receiving a signal transmitted from the flow rate sensor 290.

Next, in the second steam flow rate determining step S8, the steam flow rate determination unit 155 determines whether the amount of the steam G is smaller than a specified amount on the basis of the amount of the steam G detected by the steam flow rate detection unit 154 (step S20). When the steam flow rate determination unit 155 determines that "the steam amount is equal to or larger than the specified amount" (step S20: NO), for example, the routine returns to the process of step S18.

On the other hand, when the steam flow rate determination unit 155 determines that "the steam amount is smaller than the specified amount" (step S20: YES), in the second steam switching step S9, the steam switching unit 151 switches the opening and closing states of the governing valve 240 and the dump valve 250 by operating the governing valve 240 and the dump valve 250 (step S21). Specifically, the steam switching unit 151 switches the governing valve 240 to the closed state and switches the dump valve 250 to the open state.

The processes from step S10 to step S20 described above are repeatedly performed during operation of the ammonia plant.

Operation and Effect

According to the above-described configuration, the pressure inside the steam turbine 30 can be reduced by the vacuum pump 120 while a gap between the turbine stator 30*a* and the turbine rotor 30*b* of the steam turbine 30 is sealed by the shaft seal device 140. That is, the inside of the steam turbine 30 can be evacuated. Thus, for example, the motor 50 can start the driving of the steam turbine 30 while the pressure inside the steam turbine 30 is reduced. As a result, for example, the load applied to the motor 50 at the start of driving the steam turbine 30 can be reduced.

Further, according to the above-described configuration, the steam turbine 30 can be driven while the pressure inside the steam turbine 30 is reduced until the amount of the steam G generated in accordance with the processing of the process gas P becomes equal to or larger than the specified amount. In other words, the steam turbine 30 of which the inside is evacuated can be driven until the amount of the steam G reaches the specified amount or more. Thus, for example, it is possible to suppress the temperature inside the steam turbine 30 from rising when starting the steam turbine 30 to be driven. As a result, for example, damage to the parts of the steam turbine 30 inside the steam turbine 30 can be suppressed. Further, it is possible to suppress an increase in the load applied to the motor 50 when starting to drive the steam turbine 30. Thus, the power required for operating the compressor train 1 of chemical plants can be suppressed.

Further, according to the above-described configuration, when the amount of the steam G generated in accordance with the processing of the process gas P becomes smaller than the specified amount, it is possible to stop the inflow of the steam G into the steam turbine 30. Then, the pressure inside the steam turbine 30 is reduced as the vacuum pump 120 is driven after the flow of the steam G into the steam turbine 30 is stopped. That is, when the flow of the steam G into the steam turbine 30 is stopped, the inside of the steam turbine 30 can evacuated. Thus, for example, it is possible to suppress the temperature inside the steam turbine 30 from rising when stopping the driving of the steam turbine 30. Further, it is possible to suppress an increase in the load applied to the motor 50 when stopping the driving of the steam turbine 30.

Further, in the above embodiments, the inflow state of the steam G into the steam turbine 30 can be switched by the governing valve 240 disposed in the steam introduction line 201 and the dump valve 250 disposed in the connection line 160. Accordingly, the above-described effects can be achieved with a more specific configuration. Further, in the above embodiments, when the governing valve 240 is closed and the dump valve 250 is opened, the steam G flowing through the steam introduction line 201 is introduced into the condenser 90 in a depressurized state. Thus, for example, there is no need to separately provide a device within the ammonia plant 100 for receiving the steam G flowing through the steam introduction line 201. As a result, it is possible to suppress the ammonia plant 100 from increasing in size.

Other Embodiments

Although the embodiments of the present disclosure have been described above in detail with reference to the drawings, the specific configuration is not limited to the configuration of the embodiments and additions, omissions, substitutions, and other changes to the configuration are possible without departing from the gist of the present disclosure. Further, the present disclosure is not limited by the embodiments, but only by the claims.

Figure 9:
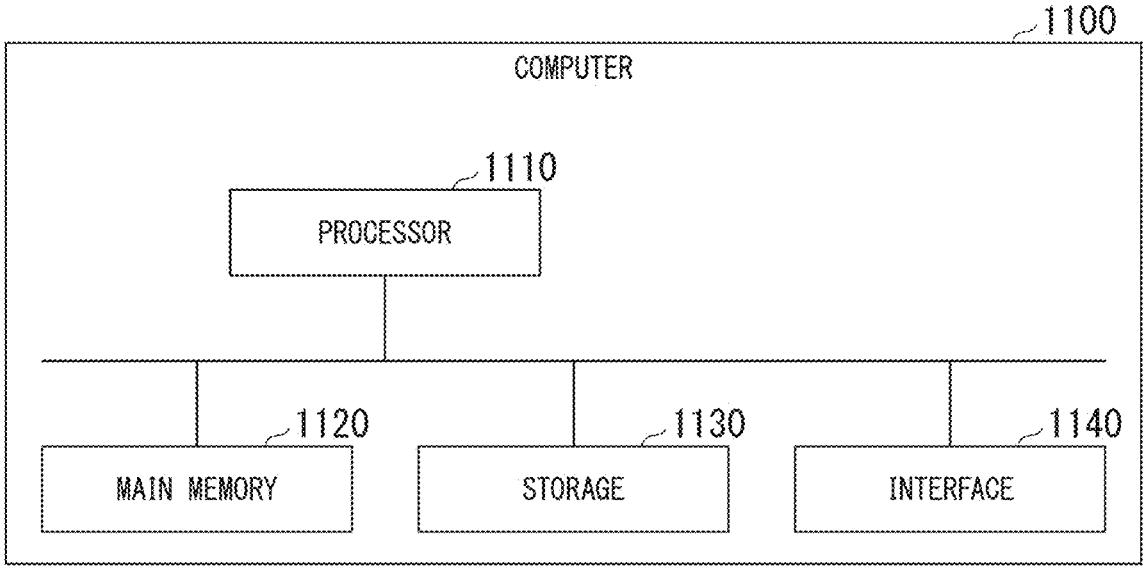
FIG. 9 is a hardware configuration diagram showing a configuration of a computer according to the embodiment of the present disclosure.

Furthermore, FIG. 9 is a hardware configuration diagram showing a configuration of a computer 1100 according to this embodiment.

The computer 1100 includes a processor 1110, a main memory 1120, a storage 1130, and an interface 1140.

The control device 150 is mounted on the computer 1100. Then, the operations of each processing unit described above are stored in the storage 1130 in the form of a program. The processor 1110 reads the program from the storage 1130, deploys the program to the main memory 1120, and executes the above processing according to the program. Further, the processor 1110 reserves a storage area corresponding to the storage unit 156 described above in the main memory 1120 according to the program. The program may be for realizing some of the functions to be executed by the computer 1100. For example, the program may function in combination with another program already stored in the storage 1130 or in combination with another program installed in another device.

Further, the computer 1100 may include a custom LSI (Large Scale Integrated Circuit) such as a PLD (Programmable Logic Device) in addition to or in place of the above configuration. Examples of PLDs include PAL (Programmable Array Logic), GAL (Generic Array Logic), CPLD (Complex Programmable Logic Device), and FPGA (Field Programmable Gate Array). In this case, a part or all of the functions implemented by the processor 1110 may be implemented by the integrated circuit.

Examples of the storage 1130 include magnetic disks, magneto-optical disks, semiconductor memories, etc. The storage 1130 may be internal media connected directly to the bus of the computer 1100, or external media connected to the computer 1100 via an interface 1140 or a communication line.

Further, when this program is distributed to the computer 1100 via a communication line, the computer 1100 that receives the distribution may deploy the program in the main memory 1120 and execute the above processing. In the above embodiments, the storage 1130 is a non-transitory tangible storage medium.

Further, the program may be for realizing some of the functions described above. Furthermore, the program may be a so-called difference file (difference program) that implements the above-described functions in combination with other programs already stored in the storage 1130.

Figure 10:
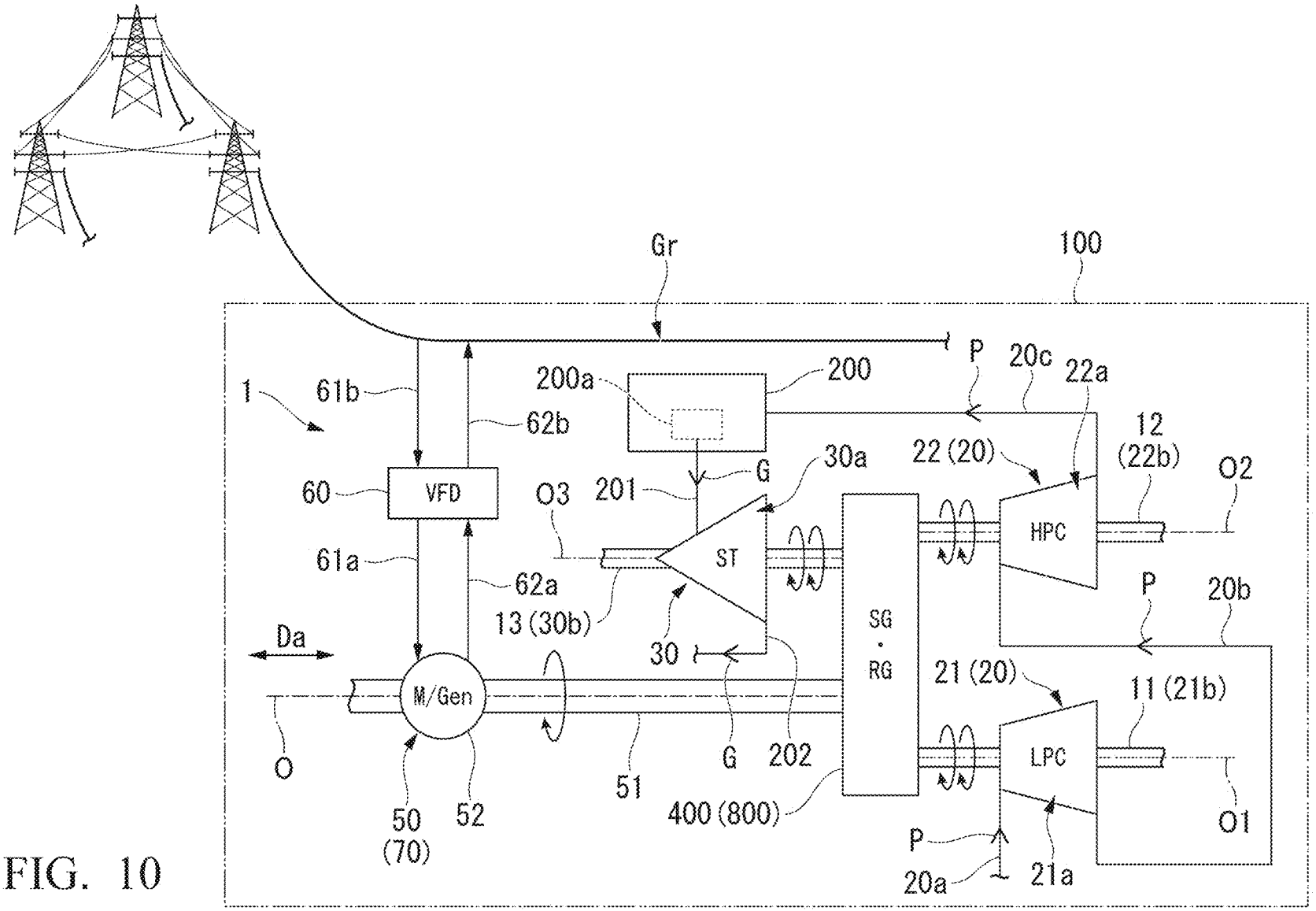
FIG. 10 is a schematic view showing a configuration of a compressor train for a chemical plant according to another embodiment of the present disclosure.

Further, as shown in FIG. 10, the configuration described in the second embodiment and the configuration described in the third embodiment may be combined. Accordingly, the same effects as in the above embodiments can be achieved.

Further, in the first and second embodiments, although a configuration in which the center line of the rotating shaft 10 and the center line of the output shaft 51 are on the same straight line (on the axis O) has been described, this configuration includes not only cases where the lines are completely on the same straight line, but also cases where they are slightly shifted.

Further, in the first and second embodiments, although a configuration in which the first rotating shaft 11, the second rotating shaft 12, and the turbine rotating shaft 13 share the axis O as a center line has been described, the present disclosure is not limited to this configuration. The center lines of the first rotating shaft 11, the second rotating shaft 12, and the turbine rotating shaft 13 may not completely on the same straight line as the axis O, but may be slightly shifted or tilted.

Further, in the first and second embodiments, the center line of the rotating shaft and the center line of the output shaft 51 may not be on the same straight line. That is, the output shaft 51 may be eccentric with respect to the rotating shaft 10.

Further, the high-pressure stage compressor 22 of the first and second embodiments may be disposed between the low-pressure stage compressor 21 and the steam turbine 30. That is, the high-pressure stage compressor 22 may be disposed in the rotating shaft 10 on the other side in the axial direction Da than the low-pressure stage compressor 21 and on one side in the axial direction Da than the steam turbine 30.

Further, the steam turbine 30 of the first and second embodiments may be disposed on one side in the axial direction Da than the compression unit 20.

Further, the steam turbine 30 of the first and second embodiments may be disposed between the low-pressure stage compressor 21 and the high-pressure stage compressor 22 of the compression unit 20. At this time, the low-pressure stage compressor 21 may be disposed on one side in the axial direction Da than the high-pressure stage compressor 22 and on the other side in the axial direction Da than the high-pressure stage compressor 22.

Further, in the first and second embodiments, although the first rotating shaft 11 and the second rotating shaft 12 are connected and the first rotating shaft 11 and the turbine rotating shaft 13 are connected by a joint, the configuration is not limited thereto. For example, these may be connected together by welding, bolting, or the like.

Further, in the first and second embodiments, although the rotating shaft 10 is configured by the turbine rotating shaft 13 in the steam turbine 30, the first rotating shaft 11 in the low-pressure stage compressor 21, and the second rotating shaft 12 in the high-pressure stage compressor 22, the present disclosure is not limited to this configuration.

As the above-described example, instead of a configuration in which the steam turbine 30, the low-pressure stage compressor 21, and the high-pressure stage compressor 22 have respective drive shafts (the first rotating shaft 11, the second rotating shaft 12, and the turbine rotating shaft 13), a configuration may be employed in which the compressor train 1 of chemical plants has one rotating shaft and the steam turbine 30, the low-pressure stage compressor 21, and the high-pressure stage compressor 22 share the rotating shaft as a common drive shaft. Accordingly, for example, there is no need to use a member for connecting the drive shafts.

Further, the compressor train 1 of chemical plants of the first and second embodiments may further include a speed increaser that connects the turbine rotating shaft 13 and the low-pressure stage compressor 21 and can increase the rotational speed of the first rotating shaft 11 to a higher speed than the rotational speed of the turbine rotating shaft 13.

Further, the compressor train 1 of chemical plants of the first and second embodiments may include a speed increaser that connects the turbine rotating shaft 13 and the low-pressure stage compressor 21 and increases the rotational speed of the first rotating shaft 11 to a higher speed than the rotational speed of the turbine rotating shaft 13 instead of the speed increaser 40.

Further, the determination on whether the amount of the steam G introduced into the steam turbine 30 of the second embodiment exceeds a predetermined threshold value is based on the measurement result of the flow rate and the flow velocity of the steam G introduced into the steam turbine 30 measured by a flow meter or a current meter provided in the steam introduction line 201.

Further, the determination on whether the amount of the steam G introduced into the steam turbine 30 of the second embodiment exceeds a predetermined threshold value may be based on the detection result of the temperature of the process gas P passing through the compression unit 20 detected by a temperature sensor provided in the gas discharge line 20*c*.

Further, the first axis O1, the second axis O2, and the turbine axis O3 of the third embodiment are not limited to a configuration parallel to the axis O. The first axis O1, the second axis O2, the turbine axis O3, and the axis O may be shifted from each other.

Further, the speed increaser 400 of the third embodiment can be disconnected from the first rotating shaft 11 and the second rotating shaft 12 and can be connected only to the motor 50 and the turbine rotating shaft 13, but the present disclosure is not limited to this configuration. For example, the speed increaser 400 may be temporarily disconnected from the output shaft 51 of the motor 50 and connected only to the turbine rotating shaft 13, the first rotating shaft 11, and the second rotating shaft 12. The speed increaser 400 may be able to switch these to an appropriate connection mode.

Further, the parallel gears of the speed increaser 400 of the third embodiment can increase the rotational speed to be higher than the rotational speed of the output shaft 51 of the motor 50 in the order of the turbine rotating shaft 13, the first rotating shaft 11, and the second rotating shaft 12, but the present disclosure is not limited to this order. For example, the parallel gears may increase the rotational speed to be higher than the rotational speed of the output shaft 51 of the motor 50 in the order of the first rotating shaft 11, the second rotating shaft 12, and the turbine rotating shaft 13. The parallel gears of the speed increaser 400 may be able to appropriately switch the order of the rotational speeds of the first rotating shaft 11, the second rotating shaft 12, and the turbine rotating shaft 13.

Further, the parallel gears of the speed increaser 400 of the third embodiment can respectively increase the rotational speeds of the first rotating shaft 11, the second rotating shaft 12, and the turbine rotating shaft 13 to different speeds, but the present disclosure is not limited to this configuration. The parallel gears may be able to increase the rotational speeds of two of the first rotating shaft 11, the second rotating shaft 12, and the turbine rotating shaft 13 to the same rotational speed or may be able to increase all rotational speeds to the same rotational speed.

Further, the axis O, the first axis O1, the second axis O2, and the turbine axis O3 of the above embodiments are not limited to a configuration extending in the horizontal direction and may extend while being slightly inclined with respect to the horizontal direction.

Further, the compression unit 20 of the above embodiments may further include an intercooler or the like that is provided in the intermediate line 20*b* and cools the process gas P compressed by the low-pressure stage compressor 21.

Further, although the compression unit 20 of the above embodiments includes the low-pressure stage compressor 21 and the high-pressure stage compressor 22, the present disclosure is not limited to this configuration. For example, the compression unit 20 may be configured by one compressor.

Further, the compression unit 20 may be configured by two or more compressors (multi-stage compressors).

Further, the motor 50 and the generator 70 of the above embodiments may not be the same device, but may be independent from each other. In this case, a configuration may be employed in which the motor body 52 is integrally fixed to the output shaft 51 and the generator 70 is provided in the output shaft 51 of the motor 50.

Further, the steam flow rate determination unit 155 of the control device 150 described in the fourth embodiment may further determine that "the steam amount is excessive" when the amount of the steam G flowing through the steam introduction line 201 is a predetermined upper limit amount or more. This upper limit amount is set, for example, to a value larger than the rated amount of steam flowing into the steam turbine 30 during rated operation of the steam turbine 30 (specified amount<rated steam amount<upper limit amount). For example, the upper limit amount may be stored in advance in the storage unit 156 of the control device 150.

When the steam flow rate determination unit 155 determines that "the steam amount is excessive", the steam switching unit 151 may operate the governing valve 240 and the dump valve 250 so that the amount of the steam G flowing into the steam turbine 30 becomes smaller than the upper limit amount. Specifically, the steam switching unit 151 may increase the opening degree of the dump valve 250 by decreasing the opening degree of the governing valve 240 so that the amount of the steam G flowing into the steam turbine 30 becomes smaller than the upper limit amount.

Figure 11:
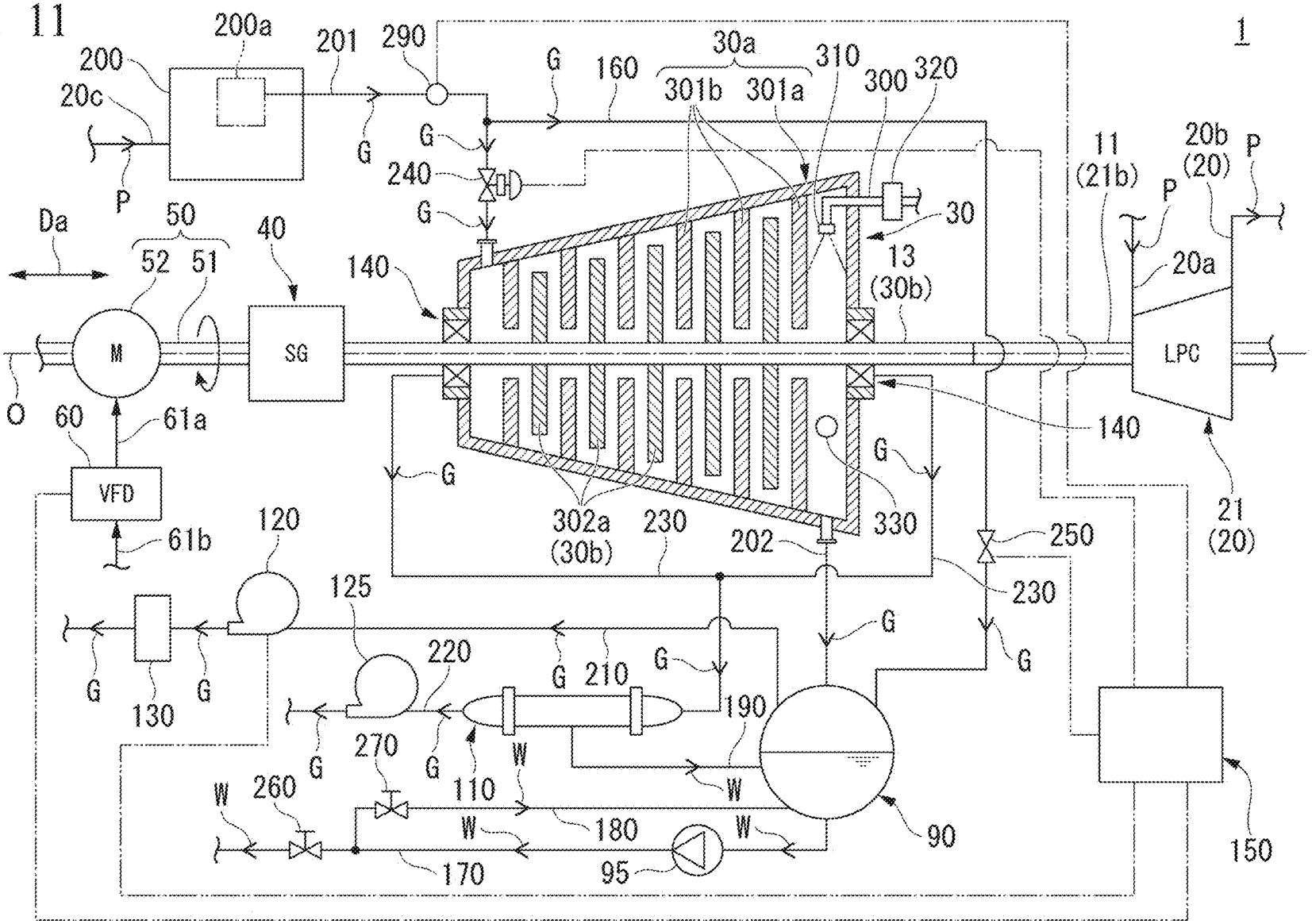
FIG. 11 is a schematic view showing a configuration of a compressor train for a chemical plant according to still another embodiment of the present disclosure.

Further, as shown in FIG. 11, the compressor train 1 of chemical plants described in the fourth embodiment may further include a spray line 300, a spray nozzle 310, a spray pump 320, and a temperature sensor 330. Hereinafter, the configurations of the spray line 300, the spray nozzle 310, and the temperature sensor 330 will be described.

The spray line 300 is a pipe through which the water W flows. One end of the spray line 300 is connected to external equipment of the steam turbine 30 and the other end of the spray line 300 is disposed, for example, on one side in the axial direction Da of the rotor blade 302*a* in the last stage inside the casing body of the steam turbine 30.

External equipment to which one end of the spray line 300 is connected includes, for example, the condenser 90. Thus, in this case, the water W stored in the condenser 90 flows into the spray line 300 toward the inside of the steam turbine 30.

The spray nozzle 310 is integrally connected to the other end of the spray line 300. The spray nozzle 310 can spray the water W inside the casing body by being connected to the spray line 300.

The spray pump 320 is disposed in the spray line 300. The spray pump 320 is driven by receiving a signal indicating a drive instruction from the control device 150 and directs the water W from external device (condenser 90) inside the spray line 300 toward the inside of the steam turbine 30.

The temperature sensor 330 is disposed inside the casing body of the steam turbine 30. The temperature sensor 330 detects the temperature inside the casing body. The temperature sensor 330 transmits a signal indicating detected temperature to the control device 150.

In this case, the control device 150 may further include, for example, a temperature detection unit (not shown) which is able to detect the temperature inside the steam turbine 30 by receiving a signal transmitted from the temperature sensor 330, a temperature determining unit (not shown) which determines the temperature inside the steam turbine 30 by comparing the temperature detected by the temperature detection unit with a predetermined temperature threshold value, and a spray pump driving unit (not shown) which drives the spray pump 320 on the basis of the determination result of the temperature determining unit.

The temperature detection unit transmits a signal indicating the temperature detected by the temperature sensor 330 to the temperature determining unit.

The temperature determining unit determines that "the temperature inside the steam turbine is abnormal" when the detection result received from the temperature detection unit (the temperature inside the steam turbine 30) indicates a temperature of the temperature threshold value or more. On the other hand, the temperature determining unit determines that "the temperature inside the steam turbine is not abnormal" when the detection result received from the temperature detection unit indicates a temperature smaller than the temperature threshold value. The temperature determining unit transmits a signal indicating the determination result to the spray pump driving unit.

The spray pump driving unit transmits a signal indicating a drive instruction to the spray pump 320 when the determination result of the temperature determining unit is that "the temperature inside the steam turbine is abnormal". On the other hand, the spray pump driving unit transmits a signal indicating a drive stop instruction to the spray pump 320 when the determination result of the temperature determining unit is that "the temperature inside the steam turbine is not abnormal".

With the above-described configuration described with reference to FIG. 11, it is possible to suppress the temperature inside the steam turbine 30 (inside the casing body) from rising above the temperature threshold value while the steam turbine 30 is being driven. Therefore, for example, damage to the parts of the steam turbine 30 inside the steam turbine 30 can be further suppressed.

Further, the vacuum pump 120 described in the fourth embodiment may directly suck air inside the steam turbine 30 without using the condenser 90.

Further, in each of the above embodiments, the configuration of the compressor train 1 of chemical plants that operates within the ammonia plant 100 has been described, but the present disclosure is not limited to this configuration. For example, the compressor train 1 of chemical plants may operate within a chemical plant such as an LNG plant or an ethylene plant.

Further, the configuration of the compressor train 1 of chemical plants described in each of the above embodiments is not limited to an independent configuration, and the compressor train 1 of chemical plants can be configured by appropriately combining the components described in each embodiment.

APPENDIX

The compressor train of chemical plants and the method of operating the compressor train of chemical plants described in each embodiment are understood, for example, as below.

(1) The compressor train 1 of chemical plants according to a first aspect includes: the compression unit 20 which is driven to compress the process gas P of the chemical plants; the steam turbine 30 which is rotated by the steam G generated in accordance with the processing of the process gas P of the chemical plants to drive the compression unit 20; the motor 50 which is able to assist the rotation of the steam turbine 30; and the frequency conversion unit 60 which is connected to the electric power system Gr and controls the rotation of the motor 50.

Accordingly, even when the amount of steam introduced into the steam turbine 30 is insufficient for the amount of steam required for the rated rotation of the compression unit 20, the rotational speed of the compression unit 20 can be increased. Further, it is possible to suppress an increase in the amount of steam introduced into the steam turbine 30 when increasing the rotational speed of the steam turbine 30.

(2) The compressor train 1 of chemical plants according to a second aspect is the compressor train 1 of chemical plants of (1), wherein the motor 50 may also serve as the generator 70 that is able to generate regenerative power in accordance with the rotation of the steam turbine 30 when amount of the steam G generated exceeds a predetermined threshold value, and wherein the frequency conversion unit 60 may be able to transmit the regenerative power to the electric power system Gr.

Accordingly, regenerative power generated using excess steam G can be sold to the electric power system Gr. That is, the amount of power purchased from the electric power system Gr to drive the motor 50 as an auxiliary to the steam turbine 30 can be partially offset.

(3) The compressor train 1 of chemical plants according to a third aspect is the compressor train 1 of chemical plants of (1) or (2), further including: the shaft seal device 140 which seals a gap between the stator (turbine stator 30*a*) of the steam turbine 30 and the rotor (turbine rotor 30*b*) of the steam turbine 30; and the vacuum pump 120 which is driven to be able to reduce the pressure inside the steam turbine 30.

Accordingly, the pressure inside the steam turbine 30 can be reduced in a sealed state using the shaft seal device 140. That is, the inside of the steam turbine 30 can be evacuated. Thus, for example, it is possible to start the driving of the steam turbine 30 by the motor 50 while the pressure inside the steam turbine 30 is reduced. As a result, for example, the load applied to the motor 50 when starting to drive the steam turbine 30 can be reduced.

(4) The compressor train 1 of chemical plants according to a fourth aspect is the compressor train 1 of chemical plants of (3), further including: the control device 150 which controls the operating status of the steam turbine 30, wherein the control device 150 may include the vacuum pump driving unit which reduces the pressure inside the steam turbine 30 by driving the vacuum pump 120 while the inflow of the steam G generated in accordance with the processing of the process gas P into the steam turbine 30 is stopped, the motor starting section 153*a* which starts to drive the steam turbine 30 by starting to drive the motor 50 while the pressure inside the steam turbine 30 is reduced and the inflow of the steam G into the steam turbine 30 is stopped, the motor driving section 153*b* which continues to drive the motor 50, and the steam switching unit 151 which starts the inflow of the steam G into the steam turbine 30 when the amount of the steam G generated in accordance with the driving of the motor 50 becomes a specified amount or more while the motor 50 continues to drive.

Accordingly, the steam turbine 30 can be driven while the pressure inside the steam turbine 30 is reduced until the amount of the generated steam G becomes a specified amount or more. Thus, for example, it is possible to suppress the temperature inside the steam turbine 30 from rising when starting to drive the steam turbine 30. Further, it is possible to suppress an increase in the load applied to the motor 50 when starting to drive the steam turbine 30.

(5) The compressor train 1 of chemical plants according to a fifth aspect is the compressor train 1 of chemical plants of (4), wherein the control device 150 may further include the motor decelerating section 153*c* which decelerates the rotation of the motor 50, and wherein the steam switching unit 151 may stop the inflow of the steam G into the steam turbine 30 when the rotation of the motor 50 is decelerated and the amount of the steam G becomes smaller than the specified amount.

Accordingly, it is possible to stop the inflow of the steam G into the steam turbine 30 when the amount of the generated steam G becomes smaller than a specified amount. Thus, for example, it is possible to suppress the temperature inside the steam turbine 30 from rising when stopping the driving of the steam turbine 30. Further, it is possible to suppress an increase in the load applied to the motor 50 when stopping the driving of the steam turbine 30.

(6) The compressor train 1 of chemical plants according to a sixth aspect is the compressor train 1 of chemical plants of (4) or (5), further including: the steam introduction line 201 which is able to guide the steam G generated in accordance with the processing of the process gas P of the chemical plants to the steam turbine 30; the steam discharge line 202 which is able to guide the steam G discharged from the steam turbine 30 to the condenser 90; the connection line 160 which is able to guide the steam G flowing through the steam introduction line 201 to the condenser 90; the governing valve 240 which is disposed at a position closer to the steam turbine 30 than the connection point between the connection line 160 and the steam introduction line 201 in the steam introduction line 201 and is able to adjust the amount of the steam G flowing through the steam introduction line 201; and the dump valve 250 which is disposed in the connection line 160 and is able to adjust the amount of the steam G flowing through the connection line 160, wherein the steam switching unit 151 may start or stop the inflow of the steam G into the steam turbine 30 by switching the governing valve 240 and the dump valve 250.

Accordingly, the above effects can be achieved with a more specific configuration. Further, when the governing valve 240 is closed and the dump valve 250 is opened, the steam G flowing through the steam introduction line 201 is introduced into the condenser 90. Thus, there is no need to separately provide a device within the chemical plant (ammonia plant 100) for receiving the steam G flowing through the steam introduction line 201. Thus, it is possible to suppress the chemical plant from increasing in size.

(7) The method of operating the compressor train 1 of chemical plants according to a seventh aspect is the method of operating the compressor train 1 of chemical plants of (3), including: the evacuation step S1 of reducing the pressure inside the steam turbine 30 by driving the vacuum pump 120 while the inflow of the steam G generated in accordance with the processing of the process gas P into the steam turbine 30 is stopped; the motor starting step S2 of starting to drive the steam turbine 30 by starting to drive the motor 50 while the inflow of the steam G into the steam turbine 30 is stopped after the evacuation step S1 is completed; the motor driving step S3 of continuing to drive the motor 50 after the motor starting step S2 is completed; and the first steam switching step S5 of starting the inflow of the steam G into the steam turbine 30 when the amount of the steam G generated in accordance with the driving of the motor 50 becomes a specified amount or more while the motor 50 continues to drive.

(8) The method of operating the compressor train 1 of chemical plants according to an eighth aspect is the method of operating the compressor train 1 of chemical plants of (7) further including: the motor decelerating step S7 of decelerating the rotation of the motor 50; and the second steam switching step S9 of stopping the inflow of the steam G into the steam turbine 30 when the rotation of the motor 50 is decelerated and the amount of the steam G becomes smaller than the specified amount.

INDUSTRIAL APPLICABILITY

According to the present disclosure, it is possible to provide the compressor train of chemical plants capable of stabilizing the pressure of the process gas compressed by the compression unit and the method of operating the compressor train of chemical plants.

REFERENCE SIGNS LIST

1 Compressor train of chemical plants
10 Rotating shaft
11 First rotating shaft
12 Second rotating shaft
13 Turbine rotating shaft
20 Compression unit
20*a* Gas introduction line
20*b* Intermediate line
20*c* Gas discharge line
21 Low-pressure stage compressor
22 High-pressure stage compressor
30 Steam turbine
30*a* Turbine stator
30*b* Turbine rotor
40, 400 Speed increaser
50 Motor
51 Output shaft
52 Motor body
60 Frequency conversion unit
61*a* First power purchasing cable
61*b* Second power purchasing cable
62*a* First power selling cable
62*b* Second power selling cable
70 Generator
80, 800 Speed reducer
90 Condenser
95 Condensate pump
100 Ammonia plant
110 Ground condenser
120 Vacuum pump
125 Vapor fan
130 Drain separator
131 Seal protrusion
140 Shaft seal device
141 Housing
141*a* Groove
141*b* Accommodation recess
141*c* Communication portion
142 Seal member
142*a* Pressure receiving portion
142*b* Base portion
142*c* Connection portion
142*d* Seal body
143 Biasing member
150 Control device
151 Steam switching unit
151*a* Governing valve operation section
151*b* Dump valve operation section
152 Vacuum pump control unit
153 Motor control unit
153*a* Motor starting section
153*b* Motor driving section
153*c* Motor decelerating section
154 Steam flow rate detection unit
155 Steam flow rate determination unit
156 Storage unit
160 Connection line
170 Drainage line
180 Circulation line
190 Condensate recovery line
200 Ammonia converter
200*a* Boiler
201 Steam introduction line
202 Steam discharge line
210 First suction line
220 Second suction line
230 Leaked steam line
240 Governing valve
250 Dump valve
260 First on-off valve
270 Second on-off valve
290 Flow rate sensor
300 Spray line
310 Spray nozzle
320 Spray pump
330 Temperature sensor
301*a* Turbine casing
301*b* Stator vane
302*a* Rotor blade
1100 Computer
1110 Processor
1120 Main memory
1130 Storage
1140 Interface
Da Axial direction
G Steam
Gr Electric power system
O Axis
O1 First axis
O2 Second axis
O3 Turbine axis
P Process gas
S1 Evacuation step
S2 Motor starting step
S3 Motor driving step
S4 First steam flow rate determining step
S5 First steam switching step
S6 Turbine operating step
S7 Motor decelerating step
S8 Second steam flow rate determining step
S9 Second steam switching step
W Water

What is claimed is:

1. A compressor train of a chemical plant comprising:

a compression unit which is driven to compress a process gas of the chemical plant;

a steam turbine which is rotated by steam generated in accordance with processing of the process gas of the chemical plant to drive the compression unit;

a motor which is able to assist a rotation of the steam turbine;

a frequency conversion unit which is connected to an electric power system and controls a rotation of the motor;

a shaft seal device which seals a gap between a stator of the steam turbine and a rotor of the steam turbine;

a vacuum pump which is driven to be able to reduce pressure inside the steam turbine; and a control device which controls an operating status of the steam turbine, wherein the control device includes a vacuum pump driving unit which reduces the pressure inside the steam turbine by driving the vacuum pump while an inflow of the steam generated in accordance with the processing of the process gas into the steam turbine is stopped, a motor starting section which starts to drive the steam turbine by starting to drive the motor while the pressure inside the steam turbine is reduced and the inflow of the steam into the steam turbine is stopped, a motor driving section which continues to drive the motor, and a steam switching unit which starts the inflow of the steam into the steam turbine when an amount of the steam generated in accordance with a driving of the motor becomes a specified amount or more while the motor continues to drive.

2. The compressor train according to claim 1, wherein the motor also serves as a generator that is able to generate regenerative power in accordance with the rotation of the steam turbine when the amount of the steam generated exceeds a predetermined threshold value, and the frequency conversion unit is able to transmit the regenerative power to the electric power system.

3. The compressor train according to claim 1, wherein the control device further includes a motor decelerating section which decelerates the rotation of the motor, and the steam switching unit stops the inflow of the steam into the steam turbine when the rotation of the motor is decelerated and the amount of the steam becomes smaller than the specified amount.

4. The compressor train according to claim 1, further comprising:

a steam introduction line which is able to guide the steam generated in accordance with the processing of the process gas of the chemical plant to the steam turbine;

a steam discharge line which is able to guide the steam discharged from the steam turbine to a condenser;

a connection line which is able to guide the steam flowing through the steam introduction line to the condenser;

a governing valve which is disposed at a position closer to the steam turbine than a connection point between the connection line and the steam introduction line in the steam introduction line and is able to adjust the amount of the steam flowing through the steam introduction line; and a dump valve which is disposed in the connection line and is able to adjust the amount of the steam flowing through the connection line, wherein the steam switching unit starts or stops the inflow of the steam into the steam turbine by switching the governing valve and the dump valve.

5. A method of operating a compressor train of a chemical plant comprising: a compression unit which is driven to compress a process gas of the chemical plant; a steam turbine which is rotated by steam generated in accordance with processing of the process gas of the chemical plant to drive the compression unit; a motor which is able to assist a rotation of the steam turbine; a frequency conversion unit which is connected to an electric power system and controls a rotation of the motor; a shaft seal device which seals a gap between a stator of the steam turbine and a rotor of the steam turbine; and a vacuum pump which is driven to be able to reduce pressure inside the steam turbine, the method comprising:

an evacuation step of reducing the pressure inside the steam turbine by driving the vacuum pump while an inflow of the steam generated in accordance with the processing of the process gas into the steam turbine is stopped;

a motor starting step of starting to drive the steam turbine by starting to drive the motor while the inflow of the steam into the steam turbine is stopped after the evacuation step is completed;

a motor driving step of continuing to drive the motor after the motor starting step is completed; and a first steam switching step of starting the inflow of the steam into the steam turbine when an amount of the steam generated in accordance with the driving of the motor becomes a specified amount or more while the motor continues to drive.

6. The method according to claim 5, further comprising:

a motor decelerating step of decelerating the rotation of the motor; and a second steam switching step of stopping the inflow of the steam into the steam turbine when the rotation of the motor is decelerated and the steam amount becomes smaller than the specified amount.

* * * * *